US009217543B2

(12) United States Patent
Yang et al.

(10) Patent No.: US 9,217,543 B2
(45) Date of Patent: Dec. 22, 2015

(54) SOLID-STATE LAMPS WITH OMNIDIRECTIONAL EMISSION PATTERNS

(71) Applicant: Intematix Corporation, Fremont, CA (US)

(72) Inventors: Haitao Yang, San Jose, CA (US); Charles Edwards, Pleasanton, CA (US); Ian Collier, Hayward, CA (US)

(73) Assignee: Intematix Corporation, Fremont, CA (US)

( * ) Notice: Subject to any disclaimer, the term of this patent is extended or adjusted under 35 U.S.C. 154(b) by 126 days.

(21) Appl. No.: 14/161,968

(22) Filed: Jan. 23, 2014

(65) Prior Publication Data

US 2014/0211467 A1 Jul. 31, 2014

Related U.S. Application Data

(60) Provisional application No. 61/757,706, filed on Jan. 28, 2013.

(51) Int. Cl.

| | |
|---|---|
| ***F21K 99/00*** | (2010.01) |
| ***F21V 3/04*** | (2006.01) |
| *F21V 23/00* | (2015.01) |
| *F21Y 101/02* | (2006.01) |
| *F21V 29/83* | (2015.01) |

(52) U.S. Cl.

CPC ..... *F21K 9/1355* (2013.01); *F21K 9/50* (2013.01); *F21V 3/0472* (2013.01); *F21V 23/006* (2013.01); *F21V 29/83* (2015.01); *F21Y 2101/02* (2013.01)

(58) Field of Classification Search

CPC ..... F21K 9/1335; F21V 3/0472; F21V 29/83; F21Y 2102/02

USPC ..... 362/34, 84, 231, 235

See application file for complete search history.

(56) References Cited

U.S. PATENT DOCUMENTS

| | | | |
|---|---|---|---|
| 3,290,255 | A | 12/1966 | Smith |
| 3,593,055 | A | 7/1971 | Geusic et al. |
| 3,670,193 | A | 6/1972 | Thorington et al. |

(Continued)

FOREIGN PATENT DOCUMENTS

| | | |
|---|---|---|
| EP | 647694 | 4/1995 |
| GB | 2 017 409 | 10/1979 |

(Continued)

OTHER PUBLICATIONS

PCT International Search Report for PCT/US2014/013187, Form PCT/ISA/210, dated May 29, 2014 (4 pages).

(Continued)

*Primary Examiner* — Anabel Ton

(74) *Attorney, Agent, or Firm* — Vista IP Law Group, LLP

(57) ABSTRACT

An inventive LED-based lamp, lamp cover component, and methods for manufacturing thereof are disclosed which provides a light diffusive lamp cover having a diffusivity (transmittance) that is different for different areas (zones or regions) of the cover. The diffusivity and location of those areas are configured so that the emission pattern of the whole lamp meets desired emissions characteristics and optical efficiency levels. The diffusive cover may have any number of specifically delineated diffusivity areas. Alternatively, the cover may provide a gradient of increasing/decreasing diffusivity portions over the cover.

20 Claims, 16 Drawing Sheets

(56) References Cited

U.S. PATENT DOCUMENTS

| | | | | |
|---|---|---|---|---|
| 3,676,668 | A | 7/1972 | Collins et al. | |
| 3,691,482 | A | 9/1972 | Pinnow et al. | |
| 3,709,685 | A | 1/1973 | Hercock et al. | |
| 3,743,833 | A | 7/1973 | Martie et al. | |
| 3,763,405 | A | 10/1973 | Mitsuhata | |
| 3,793,046 | A | 2/1974 | Wanmaker et al. | |
| 3,819,973 | A | 6/1974 | Hosford | |
| 3,819,974 | A | 6/1974 | Stevenson et al. | |
| 3,849,707 | A | 11/1974 | Braslau et al. | |
| 3,875,456 | A | 4/1975 | Kana et al. | |
| 3,932,881 | A | 1/1976 | Mita et al. | |
| 3,937,998 | A | 2/1976 | Verstegen et al. | |
| 3,972,717 | A | 8/1976 | Wiedemann | |
| 4,047,075 | A | 9/1977 | Schoberl | |
| 4,081,764 | A | 3/1978 | Christmann et al. | |
| 4,104,076 | A | 8/1978 | Pons | |
| 4,143,394 | A | 3/1979 | Schoeberl | |
| 4,176,294 | A | 11/1979 | Thornton, Jr. | |
| 4,176,299 | A | 11/1979 | Thornton | |
| 4,211,955 | A | 7/1980 | Ray | |
| 4,305,019 | A | 12/1981 | Graff et al. | |
| 4,315,192 | A | 2/1982 | Skwirut et al. | |
| 4,443,532 | A | 4/1984 | Joy et al. | |
| 4,559,470 | A | 12/1985 | Murakami et al. | |
| 4,573,766 | A | 3/1986 | Bournay, Jr. et al. | |
| 4,618,555 | A | 10/1986 | Suzuki et al. | |
| 4,638,214 | A | 1/1987 | Beers et al. | |
| 4,667,036 | A | 5/1987 | Iden et al. | |
| 4,678,285 | A | 7/1987 | Ohta et al. | |
| 4,727,003 | A | 2/1988 | Ohseto et al. | |
| 4,772,885 | A | 9/1988 | Uehara et al. | |
| 4,845,223 | A | 7/1989 | Seybold et al. | |
| 4,859,539 | A | 8/1989 | Tomko et al. | |
| 4,915,478 | A | 4/1990 | Lenko et al. | |
| 4,918,497 | A | 4/1990 | Edmond | |
| 4,946,621 | A | 8/1990 | Fouassier et al. | |
| 4,992,704 | A | 2/1991 | Stinson | |
| 5,077,161 | A | 12/1991 | Law | |
| 5,110,931 | A | 5/1992 | Dietz et al. | |
| 5,126,214 | A | 6/1992 | Tokailin et al. | |
| 5,131,916 | A | 7/1992 | Eichenauer et al. | |
| 5,143,433 | A | 9/1992 | Farrell | |
| 5,143,438 | A | 9/1992 | Giddens et al. | |
| 5,166,761 | A | 11/1992 | Olson et al. | |
| 5,208,462 | A | 5/1993 | O'Connor et al. | |
| 5,210,051 | A | 5/1993 | Carter, Jr. | |
| 5,211,467 | A | 5/1993 | Seder | |
| 5,237,182 | A | 8/1993 | Kitagawa et al. | |
| 5,264,034 | A | 11/1993 | Dietz et al. | |
| 5,283,425 | A | 2/1994 | Imamura | |
| 5,369,289 | A | 11/1994 | Tamaki et al. | |
| 5,405,709 | A | 4/1995 | Littman et al. | |
| 5,439,971 | A | 8/1995 | Hyche | |
| 5,518,808 | A | 5/1996 | Bruno et al. | |
| 5,535,230 | A | 7/1996 | Abe | |
| 5,557,168 | A | 9/1996 | Nakajima et al. | |
| 5,563,621 | A | 10/1996 | Silsby | |
| 5,578,839 | A | 11/1996 | Nakamura et al. | |
| 5,583,349 | A | 12/1996 | Norman et al. | |
| 5,585,640 | A | 12/1996 | Huston et al. | |
| 5,619,356 | A | 4/1997 | Kozo et al. | |
| 5,660,461 | A | 8/1997 | Ignatius et al. | |
| 5,677,417 | A | 10/1997 | Muellen et al. | |
| 5,679,152 | A | 10/1997 | Tischler et al. | |
| 5,763,901 | A | 6/1998 | Komoto et al. | |
| 5,770,887 | A | 6/1998 | Tadatomo et al. | |
| 5,771,039 | A | 6/1998 | Ditzik | |
| 5,777,350 | A | 7/1998 | Nakamura et al. | |
| 5,869,199 | A | 2/1999 | Kido | |
| 5,959,316 | A | 9/1999 | Lowery | |
| 5,962,971 | A | 10/1999 | Chen | |
| 5,998,925 | A | 12/1999 | Shimizu et al. | |
| 6,137,217 | A | 10/2000 | Pappalardo et al. | |
| 6,340,824 | B1 | 1/2002 | Komoto et al. | |
| 6,504,301 | B1 | 1/2003 | Lowery | |
| 6,576,488 | B2 | 6/2003 | Collins et al. | |
| 6,600,175 | B1 | 7/2003 | Baretz et al. | |
| 6,642,618 | B2 | 11/2003 | Yagi et al. | |
| 6,642,652 | B2 | 11/2003 | Collins et al. | |
| 6,869,812 | B1 | 3/2005 | Liu | |
| 7,153,015 | B2 | 12/2006 | Brukilacchio | |
| 7,311,858 | B2 | 12/2007 | Wang et al. | |
| 7,390,437 | B2 | 6/2008 | Dong et al. | |
| 7,479,662 | B2 | 1/2009 | Soules et al. | |
| 7,541,728 | B2 | 6/2009 | Wang et al. | |
| 7,575,697 | B2 | 8/2009 | Li et al. | |
| 7,601,276 | B2 | 10/2009 | Li et al. | |
| 7,615,795 | B2 | 11/2009 | Baretz et al. | |
| 7,648,650 | B2 | 1/2010 | Liu et al. | |
| 7,655,156 | B2 | 2/2010 | Cheng et al. | |
| 7,943,945 | B2 | 5/2011 | Baretz et al. | |
| 8,075,147 | B2 * | 12/2011 | Chaves et al. | 362/84 |
| 8,274,215 | B2 | 9/2012 | Liu et al. | |
| 9,004,705 | B2 * | 4/2015 | Li et al. | 362/84 |
| 2004/0016938 | A1 | 1/2004 | Baretz et al. | |
| 2006/0049416 | A1 | 3/2006 | Baretz et al. | |
| 2008/0224597 | A1 | 9/2008 | Baretz et al. | |
| 2008/0224598 | A1 | 9/2008 | Baretz et al. | |
| 2009/0283721 | A1 | 11/2009 | Liu et al. | |
| 2011/0227102 | A1 | 9/2011 | Hussell et al. | |
| 2012/0086034 | A1 | 4/2012 | Yuan et al. | |
| 2012/0182715 | A1 * | 7/2012 | Li | 362/84 |
| 2012/0262903 | A1 * | 10/2012 | Li et al. | 362/84 |
| 2013/0094178 | A1 * | 4/2013 | Huang et al. | 362/84 |
| 2013/0214676 | A1 * | 8/2013 | Li et al. | 313/512 |

FOREIGN PATENT DOCUMENTS

| | | |
|---|---|---|
| JP | S50-79379 | 11/1973 |
| JP | 60170194 | 9/1985 |
| JP | 862-189770 | 8/1987 |
| JP | H01-1794 71 | 7/1989 |
| JP | 01-260707 | 10/1989 |
| JP | H02-91980 | 3/1990 |
| JP | H3-24692 | 3/1991 |
| JP | 4010665 | 1/1992 |
| JP | 4010666 | 1/1992 |
| JP | 04-289691 | 10/1992 |
| JP | 4-321280 | 11/1992 |
| JP | 05-152609 | 6/1993 |
| JP | 6207170 | 7/1994 |
| JP | 6-267301 | 9/1994 |
| JP | 6283755 | 10/1994 |
| JP | 07-099345 | 4/1995 |
| JP | H07-176794 | 7/1995 |
| JP | 07-235207 | 9/1995 |
| JP | H7-282609 | 10/1995 |
| JP | H08-7614 | 1/1996 |
| JP | 8-250281 | 9/1996 |
| JP | 2900928 | 3/1999 |
| JP | P2003-234513 | 8/2003 |
| JP | P3724490 | 9/2005 |
| JP | P3724498 | 9/2005 |
| JP | 2010-199145 | 9/2010 |
| JP | 2012-204213 | 10/2012 |
| KR | 10-2012-0131381 | 12/2012 |
| WO | WO 9108508 | 6/1991 |

OTHER PUBLICATIONS

PCT Written Opinion for PCT/US2014/013187, Form PCT/ISA/237, dated May 19, 2014 (7 pages).

"Fraunhofer-Gesellschafl: Research News Special1997", http://www.fhg.de/press/md-e/md1997/sondert2.hlm,(accessed on Jul. 23, 1998), Jan. 1997, Publisher: Fraunhofer Institute.

Adachi, C. et al., "Blue light-emitting organic electroluminescent devices", "Appl. Phys. Lett.", Feb. 26, 1990, pp. 799-801, vol. 56, No. 9.

Akasaki, Isamu, et al., "Photoluminescence of Mg-doped p-type GaN and electroluminescence of GaN p-n junction LED", "Journal of Luminescence", Jan.-Feb., 1991, pp. 666-670, vol. 48-49 pt. 2.

(56) References Cited

OTHER PUBLICATIONS

Amano, H., et al., "UV and blue electroluminescence from Al/GaN:Mg/GaN LED treated with low-energy electron beam irradiation (LEEBI)", "Institute of Physics: Conference Series", 1990, pp. 725-730, vol. 106, No. 10.
Apr. 14, 2010 Office Action in U.S. Appl. No. 11/264,124.
Apr. 15, 2009 Office Action in U.S. Appl. No. 11/264.124, issued by Abu I Kalam.
Armaroli, N. et al., "Supramolecular Photochemistry and Photophysics. ", "J. Am. Chern. Soc.", 1994, pp. 5211-5217, vol. 116.
Aug. 21, 2006 Office Action in U.S. Appl. No. 10/623,198, issued by Thao X. Le.
Aug. 24, 2007 Office Action in U.S. Appl. No. 11/264,124, issued by Thao X. Le.
Aug. 26, 2010 Office Action in U.S. Appl. No. 12/131,118.
Berggren, M. et al., "Light-emitting diodes with variable colours from polymer blends", "Nature", Dec. 1, 1994, pp. 444-446, vol. 372.
Berggren, M., et al., "White light from an electroluminescent diode made from poly[3(4-octylphenyl)-2,2'-bithiophene] and an oxadiazole . . . ", "Journal of Applied Physics", Dec. 1994, pp. 7530-7534, vol. 76, No. 11.
Boonkosum, W. et al., "Novel Flat Panel display made of amorphous SiN:H/SiC:H thin film LED", "Physical Concepts and Materials for Novel Optoelectronic Device Applications II", 1993, pp. 40-51, vol. 1985.
Bradfield, P.L., et al., "Electroluminescence from sulfur impurities in a p-n junction formed in epitaxial silicon", "Appl. Phys. Lett", 07110/1989, pp. 10D-102, vol. 55, No. 2.
Chao, Zhang Jin, et al., "White light emitting glasses", "Journal of Solid State Chemistry", 1991, pp. 17-29, vol. 93.
Comrie, M. , "Full Color LED Added to Lumex's Lineup", "EBN", Jun. 19, 1995, pp. 28.
CRC Handbook, 63rd Ed., (1983) p. E-201.
Das, N.C., et al., "Luminescence spectra of ann-channel metal-oxide-semiconductor field-effect transistor at breakdown", 1990, pp. 1152-1153, vol. 56, No. 12.
Dec. 16. 2004 Office Action in U.S. Appl. No. 10/623,198, issued by Thao X. Le.
Dictionary Definition of Phosphor, Oxford English Dictionary Online, Mar. 9, 2012 (Only partial available due to corrupt file, on Mar. 22, 2012 in U.S. Appl. No. 12/131,119; Request for Full Reference filed).
El Jouhari, N., et al., "White light generation using fluorescent glasses activated by Ce3+, Tb3+ and Mn2+ ions", "Journal De Physique IV, Colloque C2", Oct. 1992, pp. 257-260, vol. 2.
Feb. 21, 2012 Office Action in U.S. Appl. No. 12/131,118, issued by Abul Kalam.
Feb. 26, 2008 Office Action in U.S. Appl. No. 11/264,124, issued by Abu I Kalam.
Feb. 4, 2005 Office Action in U.S. Appl. No. 10/623,198, issued by Thao X. Le.
Feb. 7, 2007 Office Action in U.S. Appl. No. 11/264,124, issued by Thao X. Le.
Forrest, S. et al. , "Organic emitters promise a new generation of displays", "Laser Focus World ", Feb. 1995, pp. 99-107.
Hamada, Y. et al. , "Blue-Light-Emitting Organic Electroluminescent Devices with Oxadiazole Dimer Dyes as an Emitter", "Jpn. J. Appl. Physics", Jun. 1992, pp. 1812-1816, vol. 31.
Hamakawa, Yoshihiro, et al., "Toward a visible light display by amorphous SiC:H alloy system", "Optoelectronics—Devices and Technologies", Dec. 1989, pp. 281-294, vol. 4, No. 2.
Hirano, Masao, et al., "Various performances of fiber-optical temperature sensor utilizing infrared-to-visible conversion phosphor", "Electrochemisty (JP)", Feb. 1987, pp. 158-164, vol. 55, No. 2, Publisher: Electrochemical Society of Japan.
Jang, S., "Effect of Avalanche-Induced Light Emission on the Multiplication Factor in Bipolar Junction Transistors", "Solid-State Electronics", 1991, pp. 1191-1196, vol. 34, No. 11.
Jan. 29, 2007 Office Action in U.S. Appl. No. 10/623,198, issued by Thao X. Le.
Jan. 30, 2006 Office Action in U.S. Appl. No. 11/264,124, issued by Thao X. Le.
Jan. 7, 2011 Office Action in U.S. Appl. No. 12/131,119, issued by Steven Y. Horikoshi.
Jul. 10, 2008 Office Action in U.S. Appl. No. 11/264,124, issued by Abu I Kalam.
Jul. 14, 2005 Notice of Allowance, Notice of Allowability, and Examiners Statement of Reasons for Allowance in U.S. Appl. No. 10/623,198, issued by Thao X. Le.
Jul. 14, 2011 Office Action in U.S. Appl. No. 12/131,119, issued by Steve Horikoshi.
Jul. 7, 2011 Office Action in U.S. Appl. No. 12/131,118, issued by Abu I Kalam.
Jun. 14, 2006 Office Action in U.S. Appl. No. 11/264,124, issued by Thao X. Le.
Jun. 26, 2007 Office Action in U.S. Appl. No. 10/623,198, issued by Thao X. Le.
Kido, J. et al. , "1,2,4-Triazole Derivative as an Electron Transport Layer in Organic Luminescent Devices", "Jpn. J. Appl. Phys. ", Jul. 1, 1993, pp. L917-L920, vol. 32.
Kido, J. et al. , "Bright blue electroluminescence from poly(N-vinylcarbazole)", "Appl. Phys. Letters", Nov. 8, 1993, pp. 2627-2629, vol. 63, No. 19.
Kido, J., et al., "White light-emitting organic electroluminescent devices using the poly(N-vinylcarbazole) emitter layer doped with . . . ", "Appl. Phys. Lett.", Feb. 14, 1994, pp. 815-817, vol. 64, No. 7.
Krames, M., et al., "Status and Future of High-Power Light-Emitting Diodes for Solid-Slate Lighting", "Journal of Display Technology", Jun. 2007, pp. 160-175, vol. 3, No. 2.
Kudryashov, V., et al., "Spectra of Superbright Blue and Green InGaN/AIGaN/GaN Light-Emitting diodes", "Journal of the European Ceramic Society", May 1996, pp. 2033-2037, vol. 17.
Larach, S., et al., "Blue emitting luminescent phosphors: Review and status", "Int'l Workshop on Electroluminescence", 1990, pp. 137-143.
LEDs and Laser Diodes, Electus Distribution, copyright 2001, available at URL:http://www.jaycar.com.au/images_uploaded/ledlaser.Pdf.
Lester, S., et al., "High dislocation densities in high efficiency GaN-based light-emitting diodes", "Appl. Phys. Lett.", Mar. 6, 1995, pp. 1249-1251, vol. 66, No. 10.
Lumogen® F Violet 570 Data Sheet; available at the BASF Chemical Company website Lumogen® F Violet 570 Data Sheet; available at the BASF Chemical Company website URL,http://worldaccount.basf.com/wa/EUen_GB/Catalog/Pigments/doc4/BASF/PRD/30048274/.pdt?title=Technicai%20Datasheet&asset_type=pds/pdf&language=EN&urn=urn:documentum:eCommerce_soi_EU :09007bb280021e27.pdf:09007bb280021e27.pdf.
Mar. 2, 2009 Office Action in U.S. Appl. No. 10/623,198, issued by Abu I Kalam.
Mar. 22, 2012 Office Action in U.S. Appl. No. 12/131,119, issued by Steven Y. Horikoshi.
Mar. 28, 2006 Office Action in U.S. Appl. No. 10/623,198, issued by Thao X. Le.
Mar. 4, 2011 Notice of Allowance, Notice of Allowability, Examiners Interview Summary, Examiners Amendment/Comment and Examiners Statement of Reason for Allowance in U.S. Appl. No. 11/264,124, issued by Abu I Kalam.
Mar. 7, 2008 Office Action in U.S. Appl. No. 10/623,198, issued by Abu I Kalam.
Maruska, H.P., "Gallium nitride light-emitting diodes (dissertation)", "Dissertation Submitted to Stanford University", Nov. 1973.
Maruska, H.P., et al., "Violet luminescence of Mg-doped GaN", "Appl. Phys. Lett.", Mar. 15, 1973, pp. 303-305, vol. 22, No. 6.
May 4, 2010 Office Action in U.S. Appl. No. 12/131,119.
McGraw-Hill, "McGraw-Hill Dictionary of Scientific and Technical Terms, Third Edition", "McGraw-Hill Dictionary of Scientific and Technical Terms", 1984, pp. 912 and 1446, Publisher: McGraw-Hill.
McGraw-Hill, "McGraw-Hill Encyclopedia of Science and Technology, Sixth Edition", "McGraw-Hill Encyclopedia of Science and Technology", 1987, pp. 582 and 60-63, vol. 9-10, Publisher: McGraw-Hill.

(56) References Cited

OTHER PUBLICATIONS

Mimura, Hidenori, et al., "Visible electroluminescence from uc-SiC/porous Si/c-Si p-n junctions", "Int. J. Optoelectron.", 1994, pp. 211-215, vol. 9, No. 2.
Miura, Noboru, et al., "Several Blue-Emitting Thin-Film Electroluminescent Devices", "Jpn. J. Appl. Phys.", Jan. 15, 1992, pp. L46-L48, vol. 31, No. Part 2, No. 1A IB.
Morkoc et al., "Large-band-gap SIC, 111-V nitride, and II-VI ZnSe-based semiconductor device technologies", J. Appl. Phys. 76(3), 1; Mar. 17, 1994; Illinois University.
Muench, W.V., et al., "Silicon carbide light-emitting diodes with epitaxial junctions", "Solid-State Electronics", Oct. 1976, pp. 871-874, vol. 19, No. 10.
Mukai, T., et al., "Recent progress of nitride-based light emitting devices", "Phys. Stat. Sol.", Sep. 2003, pp. 52-57, vol. 200, No. 1.
Nakamura, S., et al., "High-power InGaN single-quantum-well-structure blue and violet light-emitting diodes", "Appl. Phys. Lett.", Sep. 25, 1995, pp. 1868-1870, vol. 67, No. 13.
Nakamura, S., et al., "The Blue Laser Diode: GaN Based Light Emitters and Lasers", Mar. 21, 1997, p. 239, Publisher: Springer-Verlag.
Nakamura, S., et al., "The Blue Laser Diode: The Complete Story, 2nd Revised and Enlarged Edition", Oct. 2000, pp. 237-240, Publisher: Springer-Verlag.
Nov. 30, 2010 Office Action in U.S. Appl. No. 12/131/118.
Oct. 20, 2008 Office Action in U.S. Appl. No. 10/623,198, issued by Abu I Kalam.
Pankove, J.I., et al., "Scanning electron microscopy studies of GaN", "Journal of Applied Physics", Apr. 1975, pp. 1647-1652, vol. 46, No. 4.
Pavan, P., et al., "Explanation of Current Crowding Phenomena Induced by Impact Ionization in Advanced Si Bipolar Transistors by Means of . . . ", "Microelectronic Engineering", 1992, pp. 699-702, vol. 19.
Pei, Q, et al., "Polymer Light-Emitting Electrochemical Cells", "Science", Aug. 25, 1995, pp. 1086-1088, vol. 269, No. 5227.
Reexam Advisory Action dated Sep. 28, 2012 for U.S. Appl. No. 90/010,940.
Reexam Final Office Action dated May 24, 2012 for U.S. Appl. No. 90/010,940.
Reexam Final Office Action dated Nov. 7, 2011 for U.S. Appl. No. 90/010,940.
Reexam Non-Final Office Action dated Jan. 26, 2012 for U.S. Appl. No. 90/010,940.
Reexam Non-Final Office Action dated Mar. 3, 2011 for U.S. Appl. No. 90/010,940.
Reexam Non-Final Office Action dated Sep. 20, 2010 for U.S. Appl. No. 90/010,940.
Roman. D., "LEDs Turn a Brighter Blue", "Electronic Buyers News", Jun. 19, 1995, pp. 28 and 35, vol. 960, Publisher: CMP Media LLC.
Saleh and Teich, Fundamentals of Photonics, New York: John Wiley & Sons, 1991, pp. 592-594.
Sato, Yuichi, et al., "Full-color fluorescent display devices using a near-UV light-emitting diode", "Japanese Journal of Applied Physics", Jul. 1996, pp. L838-L839, vol. 35, Number ?A.
Sep. 17, 2009 Notice of Allowance, Notice of Allowability, Examiner's Amendmeni/Comment, and Examiner's Statement of Reasons for Allowance in U.S. Appl. No. 10/623,198, issued by Abul Kalam.
Sep. 29, 2009 Office Action in U.S. Appl. No. 11/264,124, issued by Abu I Kalam.
Tanaka, Shosaku, et al., "Bright white-light electroluminescence based on nonradiative energy transfer in Ce-and Eu-doped SrS thin films", "Applied Physics Letters", Nov. 23, 1987, pp. 1661-1663, vol. 51, No. 21.
Tanaka, Shosaku, et al., "White Light Emitting Thin-Film Electroluminescent Devices with SrS:Ce,Cl/ZnS:Mn Double Phosphor Layers", "Jpn. J. Appl. Phys.", Mar. 20, 1986, pp. L225-L227, vol. 25, No. 3.
The Penguin Dictionary of Electronics, 3rd edition, pp. 315,437-438, 509-510, copyright 1979, 1988, and 1998.
Ura, M. , "Recent trends of development of silicon monocarbide blue-light emission diodes", "Kinzoku ", 1989, pp. 11-15, vol. 59, No. 9.
Werner, K. , "Higher Visibility for LEDs", "IEEE Spectrum", Jul. 1994, pp. 30-39.
Wojciechowski, J. et al. , "Infrared-To-Blue Up-Converting Phosphor", "Electron Technology", 1978, pp. 31-47, vol. 11, No. 3.
Yamaguchi, Y. et al., "High-Brightness SiC Blue LEDS and Their Application to Full Color LED Lamps", "Optoelectronics-Devices and Technologies", Jun. 1992, pp. 57-67, vol. 7, No. 1.
Yang, Y., et al., "Voltage controlled two color light-emitting electrochemical cells", "Appl. Phys. Lett.", 1996, vol. 68, No. 19.
Yoshimi, Masashi, et al., "Amorphous carbon basis blue light electroluminescent device", "Optoelectronics—Devices and Technologies", Jun. 1992, pp. 69-81, vol. 7, No. 1.
Zanoni, E., et al., "Impact ionization, recombination, and visible light emission in ALGaAs/GaAs high electron mobility transistors", "J. Appl. Phys.", 1991, pp. 529-531, vol. 70, No. 1.
Zanoni, E., et al., "Measurements of Avalanche Effects and Light Emission in Advanced Si and SiGe Bipolar Transistors", "Microelectronic Engineering", 1991, pp. 23-26, vol. 15.
Zdanowski, Marek, "Pulse operating up-converting phosphor LED", "Electron Technol. ", 1978, pp. 49-61, vol. 11, No. 3.
Zhiming, Chen, et al., "Amorphous thin film white-LED and its light-emitting mechanism", "Conference Record of the 1991 International Display Research Conference", Oct. 1991, pp. 122-125.

* cited by examiner

Section A-A

Section C-C

SOLID-STATE LAMPS WITH OMNIDIRECTIONAL EMISSION PATTERNS

CROSS-REFERENCES TO RELATED APPLICATIONS

This application claims the benefit of priority to U.S. Provisional Application No. 61/757,706, filed on Jan. 28, 2013 entitled "Solid-State Lamps with Omnidirectional Emission Patterns", the content of which application is incorporated herein by reference in its entirety.

BACKGROUND OF THE INVENTION

1. Field of the Invention

This invention relates to solid-state lamps with improved emission characteristics. In particular, although not exclusively, embodiments of the invention concern LED-based (Light Emitting Diode) lamps with an omnidirectional emission pattern and light diffusive covers therefor.

2. Description of the Related Art

White light emitting LEDs ("white LEDs") are known and are a relatively recent innovation. It was not until LEDs emitting in the blue/ultraviolet part of the electromagnetic spectrum were developed that it became practical to develop white light sources based on LEDs. As taught, for example in U.S. Pat. No. 5,998,925, white LEDs include one or more phosphor materials, that is photoluminescence materials, which absorb a portion of the radiation emitted by the LED and re-emit light of a different color (wavelength). Typically, the LED chip or die generates blue light and the phosphor(s) absorbs a percentage of the blue light and re-emits yellow light or a combination of green and red light, green and yellow light, green and orange or yellow and red light. The portion of the blue light generated by the LED that is not absorbed by the phosphor material combined with the light emitted by the phosphor provides light which appears to the eye as being nearly white in color.

Due to their long operating life expectancy (>50,000 hours) and high luminous efficacy (70 lumens per watt and higher) high brightness white LEDs are increasingly being used to replace conventional fluorescent, compact fluorescent and incandescent light sources.

Typically in white LEDs the phosphor material is mixed with a light transmissive material such as a silicone or epoxy material and the mixture applied to the light emitting surface of the LED die. It is also known to provide the phosphor material as a layer on, or incorporate the phosphor material within, an optical component (a photoluminescence wavelength conversion component) that is located remotely to the LED die. Advantages of a remotely located wavelength conversion component include reduced likelihood of thermal degradation of the phosphor material and a more consistent color of generated light.

FIG. 1 shows perspective and cross sectional views of a known LED-based lamp (light bulb) 10 utilizing a remote wavelength conversion component. The lamp comprises a generally conical shaped thermally conductive body 12 that includes a plurality of latitudinal heat radiating fins (veins) 14 circumferentially spaced around the outer curved surface of the body 10 to aid in the dissipation of heat. The lamp 10 further comprises a connector cap (Edison screw lamp base) 16 enabling the lamp to be directly connected to a power supply using a standard electrical lighting screw socket. The connector cap 16 is mounted to the truncated apex of the body 12. The lamp 10 further comprises one or more blue light emitting LEDs 18 mounted in thermal communication with the base of the body 12. In order to generate white light the lamp 10 further comprises a phosphor wavelength conversion component 20 mounted to the base of the body and configured to enclose the LED(s) 18. As indicated in FIG. 1 the wavelength conversion component 20 can be a generally dome shaped shell and includes one or more phosphor materials to provide wavelength conversion of blue light generated by the LED(s). For aesthetic considerations the lamp can further comprise a light transmissive envelope 22 which encloses the wavelength conversion component.

Traditional incandescent light bulbs are inefficient and have life time issues. LED-based technology is moving to replace traditional bulbs and even CFL with a more efficient and longer life lighting solution. However the known LED-based lamps typically have difficulty matching the functionality and form factor of incandescent bulbs. In particular known LED-based lamps do not meet the required emission characteristics. Embodiments of the invention at least in-part address the limitations of the known LED-based lamps.

SUMMARY OF THE INVENTION

An inventive LED-based lamp, bulb cover component, and methods for manufacturing thereof are disclosed which provides a light diffusive bulb cover having a diffusivity (transmittance) that is different for different zones or regions of the bulb cover. The diffusivity and location of those regions are designed so that the emission pattern of the whole lamp meets desired emissions characteristics and optical efficiency levels. The diffusive bulb cover may have any number of specifically delineated diffusivity zones. Alternatively, a gradient of increasing/decreasing diffusivity portions can be provided over the bulb cover.

According to an embodiment of the invention a lamp comprises: a thermally conductive body; at least one solid-state excitation source mounted in thermal communication with the body; a photoluminescence component containing a photoluminescence material, wherein the component is hollow and encloses the at least one excitation source; and a light transmissive cover containing a light diffusive material, wherein the cover encloses the photoluminescence component and comprises a plurality of areas having different diffusivities, wherein the plurality of areas comprises a first area and a second area, and the first area corresponds to a first diffusivity and the second area corresponds to a second diffusivity, and wherein the first diffusivity is different from the second diffusivity.

The first and second areas can have differing quantities of a light diffusive material per unit area. The differing quantities of the light diffusive material per unit area can be controlled by configuring: a) a solid loading of the light diffusive material; b) a thickness of the cover containing the light diffusive material; and/or c) a thickness for a layer containing the light diffusive material.

In some embodiments the areas comprise distinct areas of different diffusivity. The boundary between areas can be abrupt or alternatively continuously graded in terms of light diffusive material. Alternatively and/or in addition the plurality of areas corresponds to at least one portion of continuously grading in terms of diffusivity.

The light diffusive material can be incorporated into the material comprising the cover. In such arrangements the thickness of the cover can define the diffusivity in each area.

Alternatively and/or in addition the light diffusive material can comprise a layer on an inner or outer surface of the cover. In such arrangements the thickness of the layer can define the diffusivity in each area.

The photoluminescence component can comprise at least a part which is generally dome-shaped such as for example a substantially hemispherical shell.

According to another embodiment a lamp comprises: a thermally conductive body; at least one solid-state excitation source mounted in thermal communication with the body; a photoluminescence component containing a photoluminescence material, wherein the component is hollow and encloses the at least one excitation source; and a light transmissive cover containing a light diffusive material, wherein the cover encloses the photoluminescence component and diffusivity of the cover is greatest at the top of the cover and decreases towards the bottom of the cover.

The diffusivity of the cover can depend on differing quantities of a light diffusive material per unit area. The differing quantities of the light diffusive material per unit area can be controlled by configuring: a) a solid loading of the light diffusive material; b) configuring a thickness of the cover containing the light diffusive material; and/or c) configuring a thickness for a layer containing the light diffusive material.

In some embodiments the light diffusive material is incorporated into the material comprising the cover. In such arrangements the thickness of the cover can vary from the top to the bottom of the cover. In some embodiments at least a portion of the thickness of the cover varies continuously. Alternatively and/or in addition the thickness of the cover varies in step-wise changes. The thickness of the cover between step-wise changes is can be substantially constant.

In other embodiments the light diffusive material comprises a layer on an inner or outer surface of the cover.

The photoluminescence component can comprise at least a part which is generally dome-shaped such as for example a substantially hemispherical shell.

BRIEF DESCRIPTION OF THE DRAWINGS

In order that the present invention is better understood solid-state lamps and light diffusive covers in accordance with embodiments of the invention will now be described, by way of example only, with reference to the accompanying drawings in which.

DETAILED DESCRIPTION OF THE INVENTION

Figure 1:
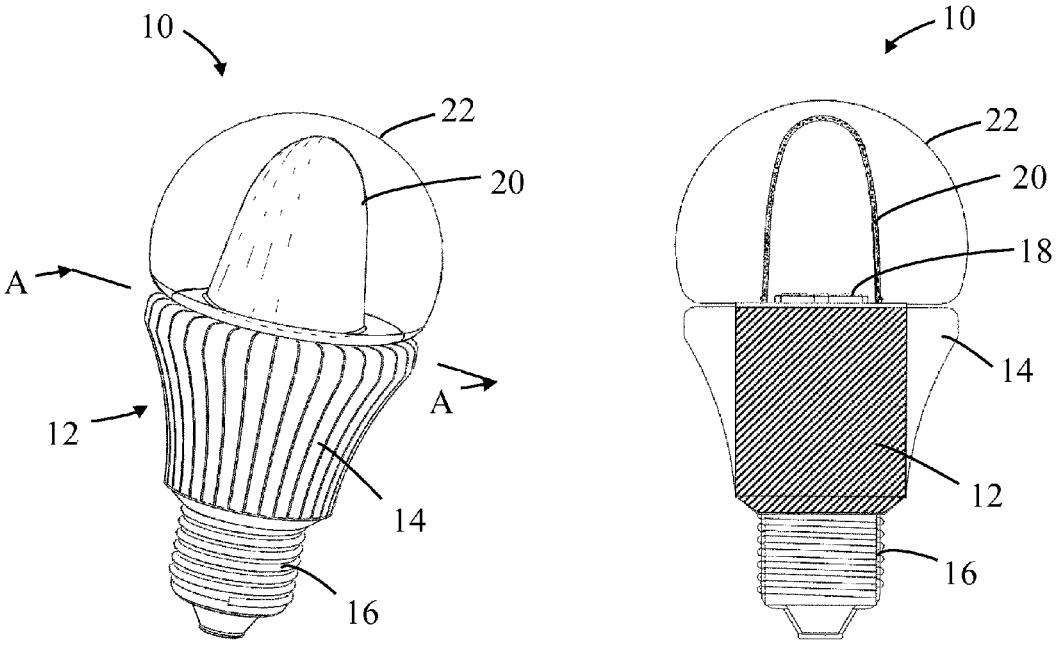
PRIOR ART FIG. 1
FIG. 1 shows perspective and cross-sectional views of a known LED-based lamp as previously described.

Lamps (light bulbs) are available in a number of forms, and are often standardly referenced by a combination of letters and numbers. The letter designation of a lamp typically refers to the particular shape or type of that lamp, such as General Service (A, mushroom), High Wattage General Service (PS—pear shaped), Decorative (B—candle, CA—twisted candle, BA—bent-tip candle, F—flame, P—fancy round, G—globe), Reflector (R), Parabolic Aluminized Reflector (PAR) and Multifaceted Reflector (MR). The number designation refers to the size of a lamp, often by indicating the diameter of a lamp in units of eighths of an inch. Thus, an A-19 type lamp refers to a general service lamp (bulb) whose shape is referred to by the letter "A" and has a maximum diameter two and three eights of an inch. As of the time of filing of this patent document, the most commonly used household "light bulb" is the lamp having the A-19 envelope, which in the United States is commonly sold with an Edison E26 screw base.

There are various standardization and regulatory bodies that provide exact specifications to define criteria under which a manufacturer is entitled to label a lighting product using these standard reference designations. With regard to the physical dimensions of the lamp, ANSI provides the specifications (ANSI C78.20-2003) that outline the required sizing and shape by which compliance will entitle the manufacture to permissibly label the lamp as an A-19 type lamp. Besides the physical dimensions of the lamp, there may also be additional specifications and standards that refer to performance and functionality of the lamp. For example in the United States the US Environmental Protection Agency (EPA) in conjunction with the US Department of Energy (DOE) promulgates performance specifications under which a lamp may be designated as an "ENERGY STAR" compliant product, e.g. identifying the power usage requirements, minimum light output requirements, luminous intensity distribution requirements, luminous efficacy requirements and life expectancy.

A problem facing solid-state lighting designers is that the disparate requirements of the different specifications and standards create design constraints that are often in tension with one another. For example, the A-19 lamp is associated with very specific physical sizing and dimension requirements, which is needed to make sure A-19 type lamps sold in the marketplace will fit into common household lighting fixtures. However, for an LED-based replacement lamp to be qualified as an A-19 replacement by ENERGY STAR, it must demonstrate certain performance-related criteria that are difficult to achieve with a solid-state lighting product when limited to the form factor and size of the A-19 light lamp.

For example, with respect to the luminous intensity distribution criteria in the ENERGY STAR specifications, for an LED-based replacement lamp to be qualified as an A-19 replacement by Energy Star it must demonstrate an even (+/−20%) light distribution over 270° and emit a minimum of 5% light above 270°. One issue is that LED replacement lamps need electronic drive circuitry and an adequate heat sink area; in order to fit these components into an A-19 form factor, the bottom portion of the lamp is replaced by a thermally conductive housing that acts as a heat sink and houses the driver circuitry needed to convert AC power to low voltage DC power used by the LEDs. A problem created by the housing of an LED lamp is that it blocks light emission in directions towards the base as is required to be ENERGY STAR compliant. As a result many LED lamps lose the lower light emitting area of traditional bulbs and become directional light sources, emitting most of the light out of the top dome (180° pattern within angles of ±90°) and virtually no light downward (i.e. ±90° to ±180°) since it is blocked by the heat sink (body), which often prevents the ability of the lamp to comply with the luminous intensity distribution criteria in the ENERGY STAR specification.

As indicated in Table 1, LED lamps targeting replacement of the 100 W incandescent light lamps need to generate 1600 lumens, for 75 W lamp replacements 1100 lumens and for 60 W lamp replacements 800 lumens. This light emission as a function of wattage is non-linear because incandescent lamp performance is non-linear.

TABLE 1

Minimum light output of omnidirectional LED lamps for nominal wattage of lamp to be replaced

| Nominal wattage of lamp to be replaced (Watts) | Minimum initial light output of LED lamp (lumens) |
|---|---|
| 25 | 200 |
| 35 | 325 |
| 40 | 450 |
| 60 | 800 |
| 75 | 1,100 |
| 100 | 1,600 |
| 125 | 2,000 |
| 150 | 2,600 |

Replacement lamps also have dimensional standards. As an example an A-19 lamp should have maximum length and diameter standards of 3½ inches long and 2⅜ inches wide. In LED lamps this volume has to be divided into a heat sink portion and a light emitting portion. Generally the heat sink portion is at the base of the LED lamp and usually requires 50% or even more of the lamp length for 60 W and higher wattage equivalent replacement lamps.

Additionally white LEDs are directional point light sources. If packaged in an array without a light diffusive (diffuser) dome or other optical cover they appear as an array of very bright spots, often called "glare". Such glare is undesirable in a lamp replacement with a larger smooth light emitting area similar to traditional incandescent bulbs being preferred. In addition to glare, LEDs mounted on a PCB (Printed Circuit Board) surface will directionally broadcast light in a pattern of 150° or less. To compensate for this an aggressive diffuser bulb may be used but this will reduce efficiency and also increase the thermal insulation of the LEDs increasing the thermal problems of cooling.

Currently LED replacement lamps are considered too expensive for the general consumer market. Typically an A-19, 40 W replacement LED lamp costs many times the cost of an incandescent bulb or compact fluorescent lamp. The high cost is due to the complex and expensive construction and components used in these lamps.

Embodiments of the present invention address, at least in part, some of the above issues.

Figure 2:
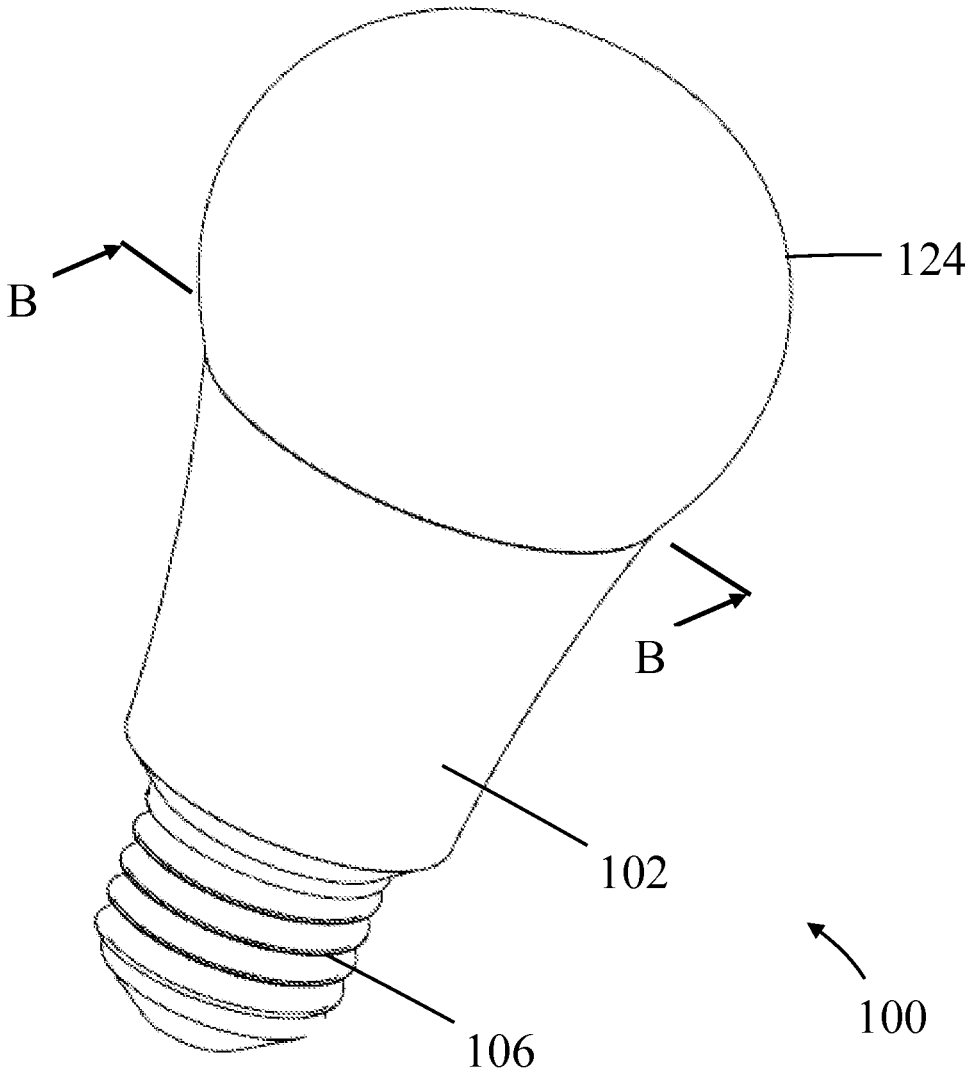
FIG. 2 is a perspective view of an LED-based lamp in accordance with an embodiment of the invention.
Figure 3:
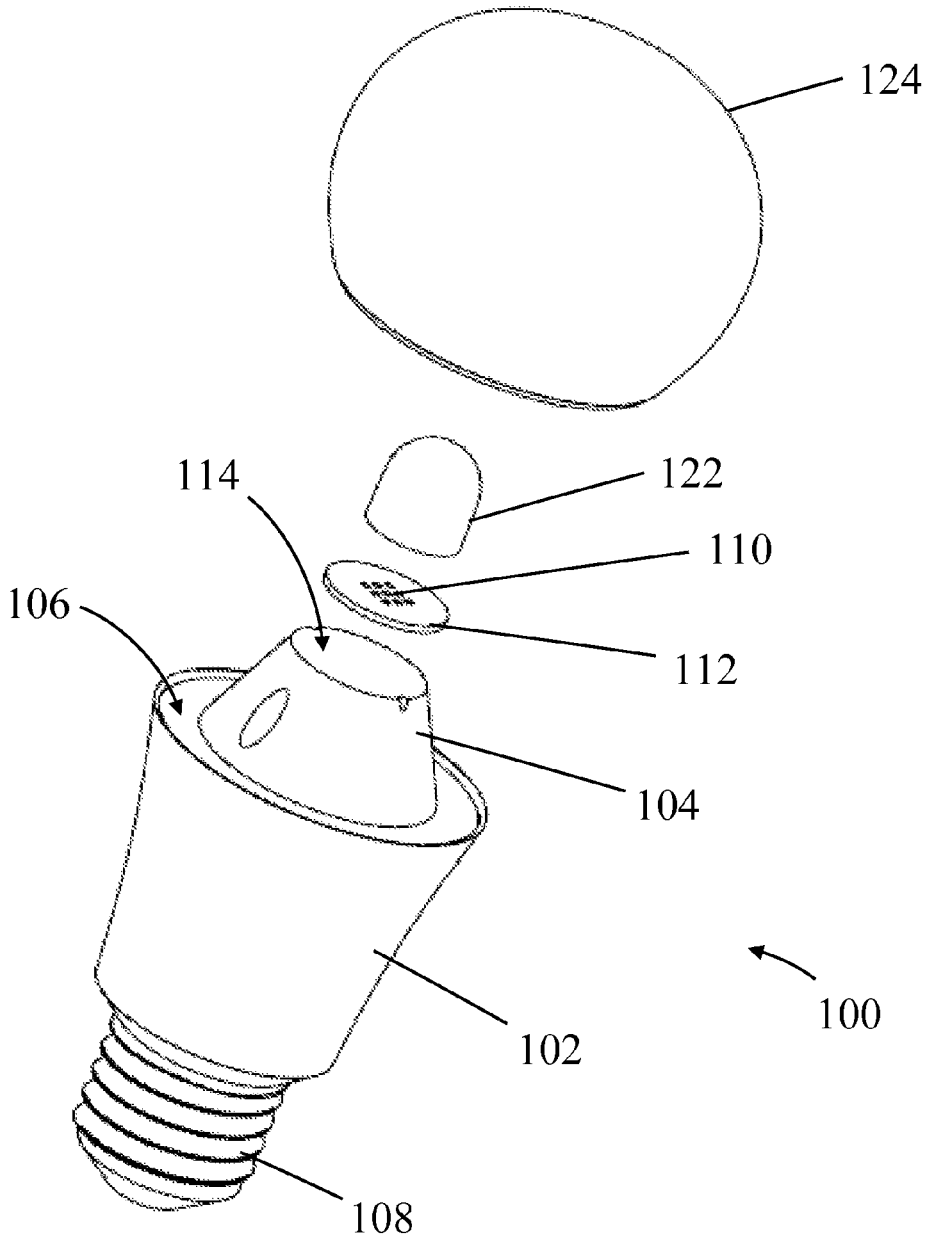
FIG. 3 is a perspective exploded view of the LED-based lamp of FIG. 2.
Figure 4:
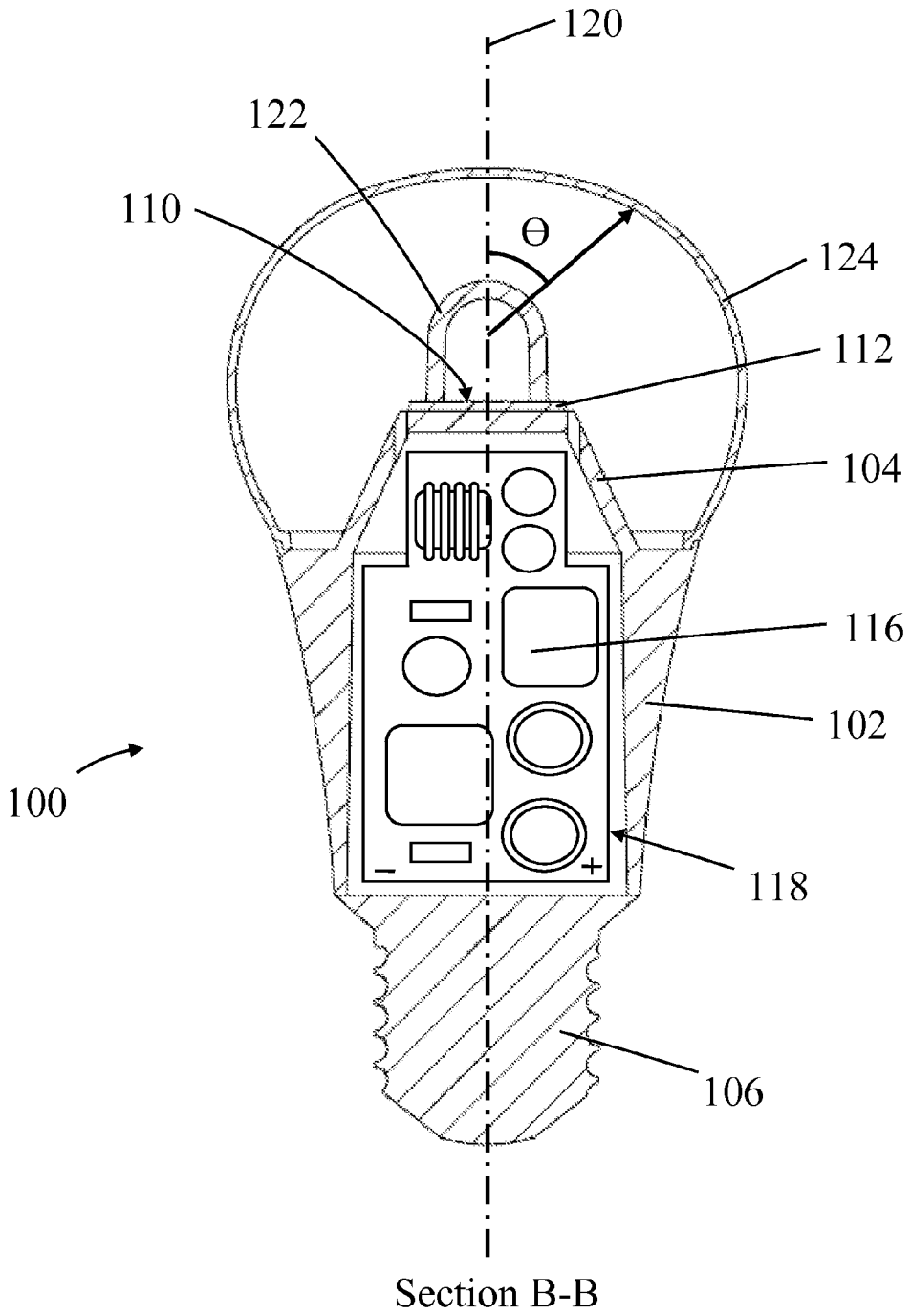
FIG. 4 is a cross-sectional view of the LED-based lamp of FIG. 2 through B-B.

An LED-based lamp 100 in accordance with an embodiment of the invention is now described with reference to FIGS. 2 to 4 and is configured as an ENERGY STAR compliant replacement for a 40 W A-19 incandescent light bulb with a minimum initial light output of 450 lumens. FIGS. 2, 3 and 4 respectively show perspective, exploded perspective and cross-sectional views of the LED-based lamp. The lamp 100 can comprise a generally conical shaped thermally conductive body 102. The outer surface of the body 102 generally resembles a frustrum of a cone; that is, a cone whose apex or vertex is truncated by a plane that is parallel to the base (i.e. substantially frustoconical). The body 102 can be made of a material with a high thermal conductivity (typically ≥150 $Wm^{-1}K^{-1}$, preferably ≥200 $Wm^{-1}K^{-1}$) such as for example aluminum (≈250 $Wm^{-1}K^{-1}$), an alloy of aluminum, a magnesium alloy, a metal loaded plastics material such as a polymer, for example an epoxy. Conveniently the body 102 can be die cast when it comprises a metal alloy or molded, by for example injection molding, when it comprises a metal loaded polymer. To aid in the dissipation of heat the body 102 can further comprise a plurality of latitudinal radially extending heat radiating fins (veins) that are circumferentially spaced around the outer curved surface of the body (not shown).

Since the lamp is intended to replace a conventional incandescent A-19 light bulb the dimensions of the lamp are selected to ensure that the device will fit a conventional lighting fixture and is compliant with ANSI C78.20-2003 and ENERGY STAR requirements. The body 102 further comprises a conical shaped thermally conductive pedestal 104 projecting from the base 106 of the body 102. As indicated in FIGS. 3 and 4 the pedestal 104 can be fabricated as an integral part of the body 102. In alternative arrangements the pedestal 104 can be fabricated as a separate component that is mounted to the base 106 of the body 102 such that it is in good thermal communication with the body.

The lamp 100 can further comprise an E26 connector cap (Edison screw lamp base) 108 enabling the lamp to be directly connected to a mains power supply using a standard electrical lighting screw socket. It will be appreciated that depending on the intended application other connector caps can be used such as, for example, a double contact bayonet connector (i.e. B22d or BC) as is commonly used in the United Kingdom, Ireland, Australia, New Zealand and various parts of the British Commonwealth or an E27 screw base (Edison screw lamp base) as used in Europe. The connector cap 108 is mounted to the truncated apex of the body 102 and the body electrically isolated from the cap.

A plurality (nine in the exemplary embodiment) of blue LEDs 110 (FIG. 3) are mounted as a square array on a circular shaped MCPCB 112 (metal core printed circuit board) which is mounted in thermal communication with the top 114 of the conical pedestal 104. The metal core base of the MCPCB can be mounted to the pedestal with the aid of a thermally conducting compound such as for example an adhesive containing a standard heat sink compound containing beryllium oxide or aluminum nitride. Rectifier and/or other driver circuitry 116 (FIG. 4) for operating the LEDs 108 directly from a mains power supply can be housed within an internal cavity 118 within the body 102 and pedestal 104.

Each LED can comprise a 0.5 W gallium nitride-based blue light emitting LED which is operable to generate blue light with a dominant wavelength of 455 nm-460 nm. The LEDs are configured such that their principle emission axis is parallel with the axis 120 of the lamp. In other embodiments the LEDs can be configured such that their principle emission axis is in a generally radial direction. A light reflective mask can be provided overlaying the MCPCB that includes apertures corresponding to each LED to maximize light emission from the lamp.

The lamp further comprises a light transmissive photoluminescence wavelength conversion component 122 that includes one or more photoluminescence materials. As indicated in the exemplary embodiment the wavelength conversion component can comprise a hemispherical shell. In some embodiments, the photoluminescence materials comprise phosphors. For the purposes of illustration only, the following description is made with reference to photoluminescence materials embodied specifically as phosphor materials. However, the invention is applicable to any type of photoluminescence material, such as either phosphor materials or quantum dots. A quantum dot is a portion of matter (e.g. semiconductor) whose excitons are confined in all three spatial dimensions that may be excited by radiation energy to emit light of a particular wavelength or range of wavelengths. The phosphor material can comprise an inorganic or organic phosphor such as for example silicate-based phosphor of a general composition $A_3Si(O,D)_5$ or $A_2Si(O,D)_4$ in which Si is silicon, O is oxygen, A comprises strontium (Sr), barium (Ba), magnesium (Mg) or calcium (Ca) and D comprises chlorine (Cl), fluorine (F), nitrogen (N) or sulfur (S). Examples of silicate-based phosphors are disclosed in United States patents U.S. Pat. No. 7,575,697 B2 "Silicate-based green phosphors", U.S. Pat. No. 7,601,276 B2 "Two phase silicate-based yellow phosphors", U.S. Pat. No. 7,655,156 B2 "Silicate-based orange phosphors" and U.S. Pat. No. 7,311,858 B2 "Silicate-based yellow-green phosphors". The phosphor can also comprise an aluminate-based material such as is taught in United States patents U.S. Pat. No. 7,541,728 B2 "Display Device with aluminate-based green phosphors" and U.S. Pat. No. 7,390,437 B2 "Aluminate-based blue phosphors", an aluminum-silicate phosphor as taught in United States patent U.S. Pat. No. 7,648,650 B2 "Aluminum-silicate orange-red phosphors with mixed Divalent and Trivalent Cations" or a nitride-based red phosphor material such as is taught in co-pending United States patent applications US2009/0283721 A1 "Nitride-based red phosphors" and United States patent U.S. Pat. No. 8,274,215 B2 "Nitride-based, red-emitting Phosphors". It will be appreciated that the phosphor material is not limited to the examples described and can comprise any phosphor material including aluminate, nitride and/or sulfate phosphor materials, oxy-nitrides and oxy-sulfate phosphors or garnet materials (YAG).

As shown in FIGS. 3 and 4 the photoluminescence wavelength conversion component 122 is mounted over the LEDs 110 on top of the pedestal 104 and fully encloses the LEDs. The lamp 100 further comprises a light diffusive bulb cover or envelope 124 mounted to the base 106 of the body and encloses the component 122. The bulb cover 124 serves two purposes: i) it improves the aesthetic appearance of the lamp such that the appearance of the lamp closely resembles a traditional incandescent light bulb which can be an important factor for many domestic consumers and ii) it modifies the emission pattern of light emitted by the wavelength conversion component 122 such that the lamp has a substantially omnidirectional emission characteristic that is Energy Star compliant. The bulb cover 124 can comprise a glass or a light transmissive polymer such as a polycarbonate, acrylic, PET or PVC that incorporates or has a layer of light diffusive (scattering) materials. Example of light diffusive materials include particles of Zinc Oxide (ZnO), titanium dioxide ($TiO_2$), barium sulfate ($BaSO_4$), magnesium oxide (MgO), silicon dioxide ($SiO_2$) or aluminum oxide ($Al_2O_3$).

In embodiments of the invention, the light diffusive bulb cover 124 has a diffusivity (transmittance) that is different for different zones or regions of the bulb cover. The diffusivity (transmittance) and location of those regions are designed so that the emission pattern of the whole lamp meets Energy Star requirement whilst maintaining a high optical efficiency. For example, in the embodiment of FIG. 5A, the diffusive bulb cover has two axial radially symmetric diffusivity zones, a top region denoted Zone 1 and a bottom region denoted Zone 2. The top region, Zone 1, has greater diffusivity (i.e. a lower transmittance), while the bottom region, Zone 2, has a lower diffusivity (i.e. a higher transmittance). For example in the embodiment of FIG. 5A, Zone 1 has a length in an axial direction of about 32.5 mm and a transmittance of about 28% (72% reflectance) and Zone 2 has a length of about 11.5 mm and a transmittance of 67% (33% reflectance).

With this kind of feature, light from the wavelength conversion component will be reflected more downward compared a known diffusive bulb cover that has uniform and this results in a more uniform light distribution to meet Energy Star emission pattern requirements. Due to the simple structure of the diffuser cover, and not requiring complicated optics, the overall optical loss of the cover is only around 10% or even lower.

One reason for the effective emission profile provided by the lamp is the non-flat nature of the photoluminescence wavelength conversion component 122. In the current embodiment, the wavelength conversion component has at least a portion that is substantially a dome or hemispherical shape. Unlike flat wavelength conversion components that directly emit most of its light in a single direction, the photoluminescence light produced by the wavelength conversion component has a shape and profile that is guided by the shape of the wavelength conversion component. With a wavelength conversion component having at least a portion that is substantially a dome or hemispherical in shape, much of the photoluminescence light is emitted laterally from the wavelength conversion component. The distribution of diffusive materials in the diffusive bulb cover is configured to work together with the shape of light produced by the wavelength conversion component to produce the final emissions characteristics of the lamp.

The combination of a non-flat wavelength conversion component with the multi-zone diffusive bulb cover therefore advantageously permits an LED-based lamp to be constructed whose shape closely resembles a conventional Edison bulb, whilst efficiently providing an emission characteristic that is compliant with any suitable standards or regulatory requirements, such as the Energy Star emissions requirements. The diffusivity and location of those regions, in combination with the light distribution patterns produced by the shape of the wavelength conversion component, are designed so that the emission pattern of the whole lamp complies with Energy Star requirements and achieve a high optical efficiency.

This invention does not only possess optical advantages, but can also provide thermal performance advantages as well. The diffuser cover part of this invention is smaller compared with other known Energy Star compliant LED-bulb designs. A smaller cover can provide more room within the lamp for heat sink components. This means that the current design can have better thermal dissipation than known LED-lamps while having the capability to handle higher power and thus provide a higher lumen output.

Figure 5A:
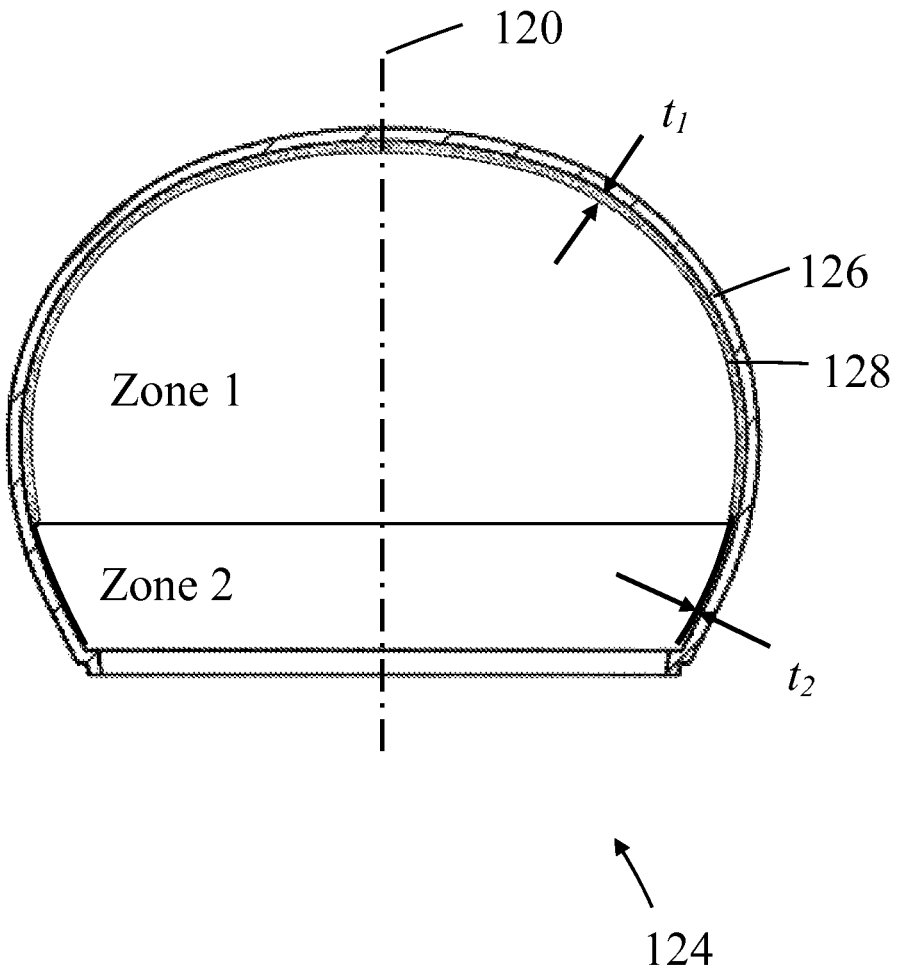
FIG. 5A is a cross-sectional view of a 2-zone light diffusive cover in accordance with an embodiment of the invention.
Figure 5B:
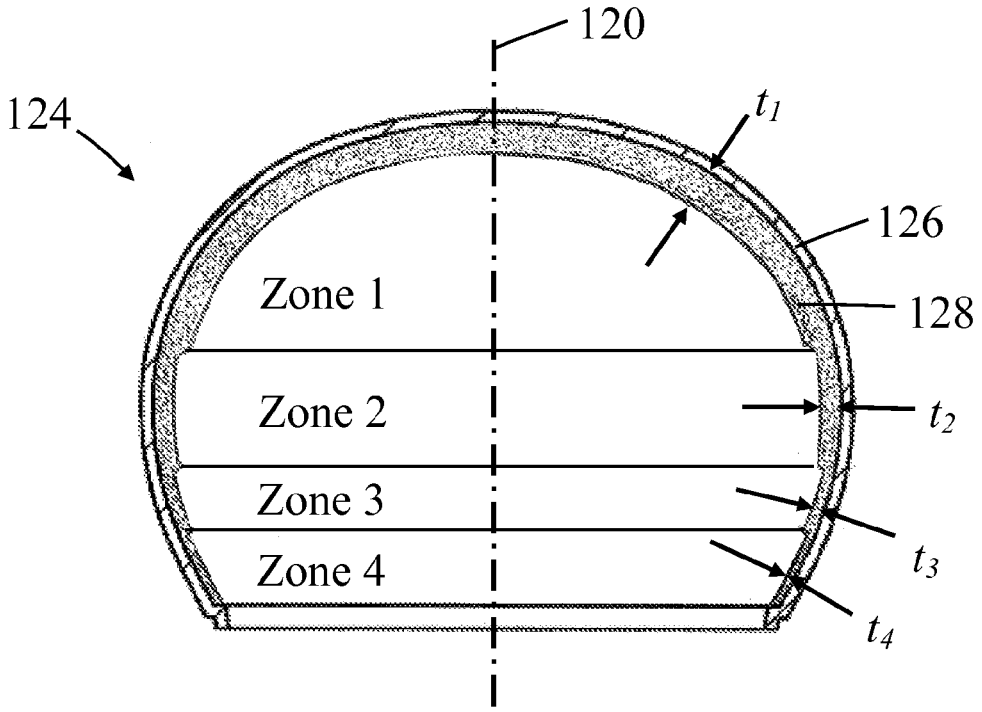
FIG. 5B is a cross-sectional view of a 4-zone light diffusive cover in accordance with an embodiment of the invention.

While the embodiment of FIG. 5A shows a diffusive bulb cover having two axial diffusivity zones, the diffusive bulb cover may include any number of axial radially symmetric diffusivity zones. For example, FIG. 5B illustrates an embodiment in which there are four axial diffusivity zones, a top region denoted Zone 1, an upper middle region denoted Zone 2, a lower middle region denoted Zone 3, and a bottom region denoted Zone 4. The top part has the highest diffusivity (lowest transmittance), the upper and lower middle zones have intermediate levels of diffusivity (medium transmittance), and the bottom part has the lowest diffusivity (highest transmittance). The number of diffusivity zones to use for any particular lamp design is selected as necessary to meet desired emission characteristics, and/or as may be needed to match the emission characteristics of the wavelength conversion component. For example in the embodiment of FIG. 5B, Zone 1 has a length in an axial direction of about 20 mm and a transmittance of about 28% (72% reflectance), Zone 2 has a length in an axial direction of about 10 mm and a transmittance of about 40% (60% reflectance), Zone 3 has a length in an axial direction of about 5 mm and a transmittance of about 50% (50% reflectance), and a length in an axial direction of about 8 mm and a transmittance of about 66.67% (33.3% reflectance).

Figure 5C:
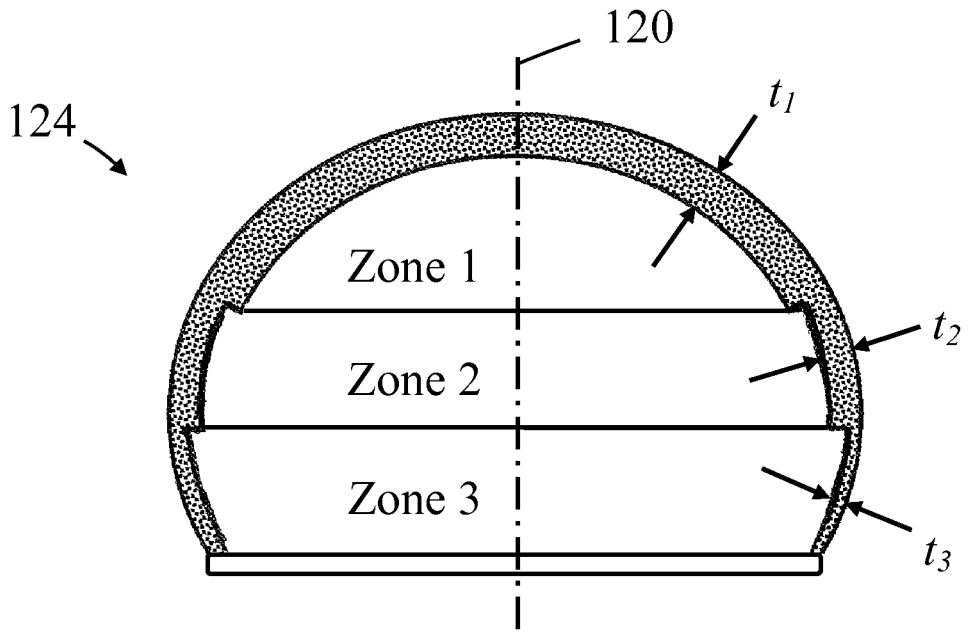
FIG. 5C is a cross-sectional view of a 3-zone light diffusive cover in accordance with an embodiment of the invention.

As another example, FIG. 5C illustrates an embodiment in which there are three axial symmetric diffusivity zones, a top region denoted Zone 1, a middle region denoted Zone 2, and a bottom region denoted Zone 3. The top part has the highest diffusivity (lowest transmittance), the middle zone has intermediate levels of diffusivity (medium transmittance), and the bottom part has the lowest diffusivity (highest transmittance).

Figure 5D:
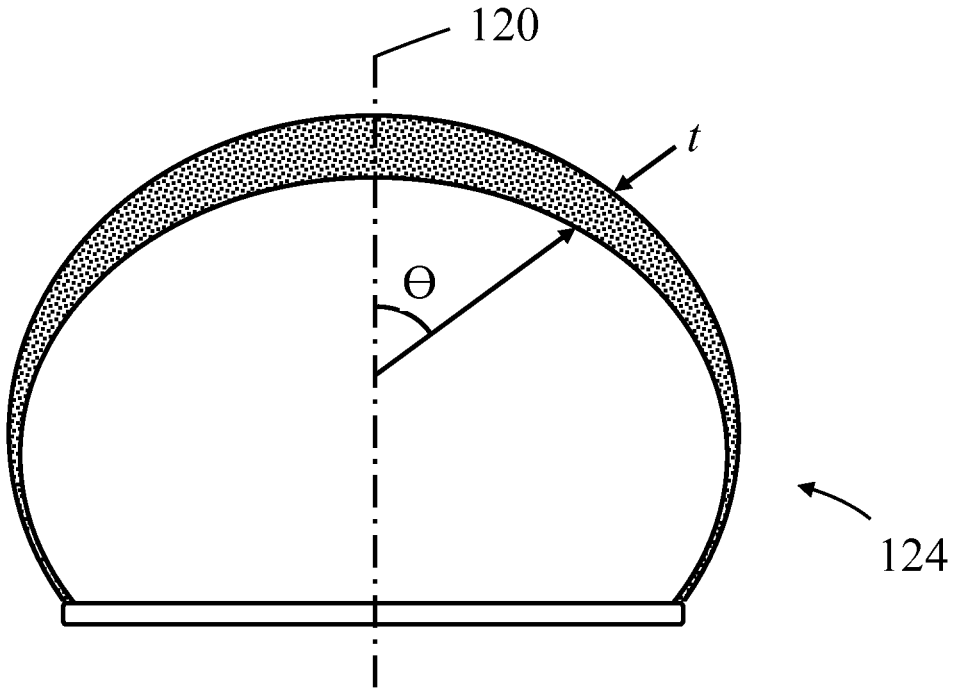
FIG. 5D is a cross-sectional view of a light diffusive cover having a smoothly varying light diffusive property in accordance with an embodiment of the invention.
Figure 5E:
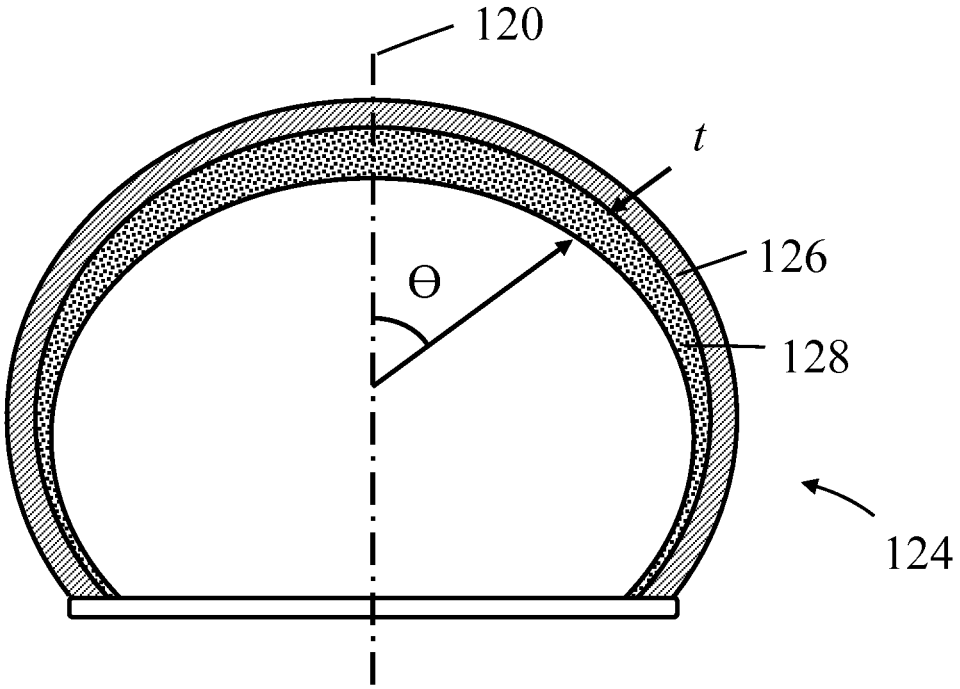
FIG. 5E is a cross-sectional view of a light diffusive cover having a smoothly varying light diffusive property in accordance with an embodiment of the invention.

In the alternative embodiments of FIGS. 5D and 5E, the bulb cover does not have specifically delineated diffusivity zones. Instead, the bulb cover has a gradient diffusivity change from the top of the bulb cover to the bottom. The heaviest diffusivity is at the top with decreasing diffusivity towards the bottom of the bulb cover.

One reason for using the diffusivity gradient instead of delineated diffusivity zones is to avoid creating prominently visible differences at the border of a first zone from a second zone. Such a visible line/boundary between two distinct regions of light emissions can be aesthetically unappealing and detract from the visual appearance of the lamp. Another possible advantage is that the diffusivity gradient approach may be used to provide a more uniform beam pattern. A carefully designed gradient profile can be implemented to promote the uniformity of the emission characteristic of the lamp, with consideration of emission characteristic of the wavelength conversion component. The rate of increase/decrease of diffusivity is selected to design a required gradient profile for the bulb cover.

Different approaches can be taken to incorporate the diffusive materials with the bulb cover 124. One possible approach according to a first embodiment is to embed the diffusive materials throughout the material that makes up the cover 124. Another possible approach according to a second embodiment is to deposit the diffusive materials onto a layer of the cover 124, e.g. where the light diffusive material is provided as a layer on the inner and/or outer surfaces of the cover.

In the approach whereby the diffusive material is embedded within the cover material, the light diffusive material can be homogeneously distributed throughout the volume of the cover 124. In this approach, the diffusive properties of the different zones are implemented by modifying the thickness of the cover material for each zone as appropriate.

For example, FIG. 5C illustrates an embodiment in which the diffusive materials are homogeneously distributed within the cover material, and where there are three axial symmetric diffusivity zones, a top Zone 1, a middle Zone 2, and a bottom Zone 3. Different thicknesses of the cover material are implemented to create the three zones, so that the top part for Zone 1 has the greatest thickness $t_1$ of the cover material (resulting in a greater diffusivity and lower transmittance), the middle Zone 2 has an intermediate thickness $t_2$ of the cover material (for medium levels of diffusivity and medium transmittance), and the bottom Zone 3 has the smallest thickness $t_3$ (resulting in a lower diffusivity and higher transmittance).

In the embodiment of FIG. 5D, the bulb cover 124 does not have specifically delineated diffusivity zones but instead has a gradient diffusivity change from the top of the bulb cover to the bottom. When the diffusive materials are homogeneously distributed within the cover material, the thickness t of the cover material therefore continuously changes as a factor of angle θ from central axis 120. The highest diffusivity is at the top, and hence the thickness t of the cover material is the greatest when the value of θ is zero. The thickness t of the cover material decreases as the angle θ is increased, and hence the diffusivity gradually decreases towards the bottom of the bulb cover 124.

The diffusive material may also be embedded within the cover material, such that the light diffusive material is non-homogeneously distributed throughout the volume of the cover 124. The cover may have multiple zones with different light diffusive properties, where the cover is fabricated in multiple parts that can be manufactured with different solid loading of light diffuser in each part. This permits the thickness of the cover material to remain relatively constant, while still allowing different portions of the cover 124 to possess differing levels of diffusivity. If the intent is to have the highest diffusivity at the top with decreasing diffusivity towards the bottom of the bulb cover 124, then the highest loading of the light diffuser material can be implemented at the top of the cover, with one or more lower loading(s) of the light diffuser towards the bottom of the bulb.

In some embodiments the cover 124 is fabricated from a resiliently deformable (semi-flexible) light transmissive material (such as a silicone material) that is combined with the light diffusive materials. Silicone is also an injection moldable material—however the injection molding is done when the material is cold. The mold is then heated and the parts start to "set" in the mold. A silicone part can be ejected when it is still flexible allowing it to be stretched and frequented ejected by compressed air off of the mold core. In this way bulb like shapes can be made with simple molds. In addition, silicone is a high temperature material—silicone can withstand temperatures of 150-200° C. and even higher. PVC is one of the higher temperature clear plastics, but extended operating temperature is often limited to 105° C. Acrylic and PET have significantly lower maximum operating temperatures. This makes silicone preferred for higher lumen applications where more heat and light is generated. A benefit of using a resiliently deformable material is that this assists in removal of the component from a former on which the component is molded. Alternatively the component can be fabricated from a semi rigid material by injection molding and be fabricated from polycarbonate or acrylic. When the component is fabricated from a material that is not flexible the component can be fabricated in two parts thereby eliminating the need to use a collapsible former during the molding process. As noted above, the light diffusive material can be homogeneously distributed throughout the volume of the cover 124. Alternatively, to mold the cover having multiple zones with different light diffusive properties, the cover can be fabricated in multiple parts with different solid loading of light diffuser in each part.

In an alternative embodiment, instead of embedding the diffusive materials within the cover material, the diffusive materials are provided as one or more layers on the inner and/or outer surfaces of the cover. In this approach, the diffusive properties of the different zones are implemented by modifying the thickness of the layer of diffusive material for each zone as appropriate.

For example, FIG. 5A illustrates an embodiment in which the diffusive materials are provided as a layer on a light transmissive cover 126, and where there are two axial diffusivity zones, a top Zone 1 and a bottom Zone 2. Different thicknesses of the layer of diffusive materials are implemented to create the two zones, so that Zone 1 has the greatest thickness t1 for diffusive material layer 128 (resulting in a greater diffusivity and lower transmittance), while Zone 2 has the smallest thickness t2 for diffusive material layer 128 (resulting in lower diffusivity and higher transmittance).

This approach can be applied to implement different thicknesses for layers of diffusive materials for any number of zones. FIG. 5B illustrates an embodiment in which there are four axial diffusivity zones, a top region denoted Zone 1, an upper middle region denoted Zone 2, a lower middle region denoted Zone 3, and a bottom region denoted Zone 4. Zone 1 has the highest diffusivity (lowest transmittance), and hence has the greatest thickness $t_1$ for the diffusive material layer 128. Zone 2 has a lower level of diffusivity, and hence corresponds to a smaller thickness $t_2$ for the diffusive material layer 128. Zone 3 has an even lower level of diffusivity, and hence corresponds to an even smaller thickness $t_3$ for the diffusive material layer 128. Finally, Zone 4 has the lowest diffusivity level, and therefore has the smallest thickness $t_4$ for the diffusive material layer 128.

Unlike the embodiments of FIGS. 5A and 5B, the embodiment of FIG. 5E does not have specifically delineated diffusivity zones for the bulb, but instead has a gradient diffusivity change from the top of the bulb cover to the bottom. To implement the embodiment of FIG. 5E where the diffusive materials are provided as a layer 128 on the light transmissive cover 126, the thickness t of the diffusive material layer 128 therefore continuously changes as a factor of angle θ from central axis 120. The greatest diffusivity is at the top, and hence the thickness t of the diffusive material layer 128 is the greatest when the value of θ is zero. The thickness t of the diffusive material layer 128 decreases as the angle θ is increased, and hence the diffusivity gradually decreases towards the bottom of the cover 124.

Any suitable approach can be used to deposit the diffusion material layer 128 onto the light transmissive cover 126 to form cover 124. Such suitable deposition techniques in some embodiments include, for example, spraying, painting, spin coating, screen printing or including the diffusive materials on a sleeve that is placed adjacent to the light transmissive cover 126.

Figure 5F:
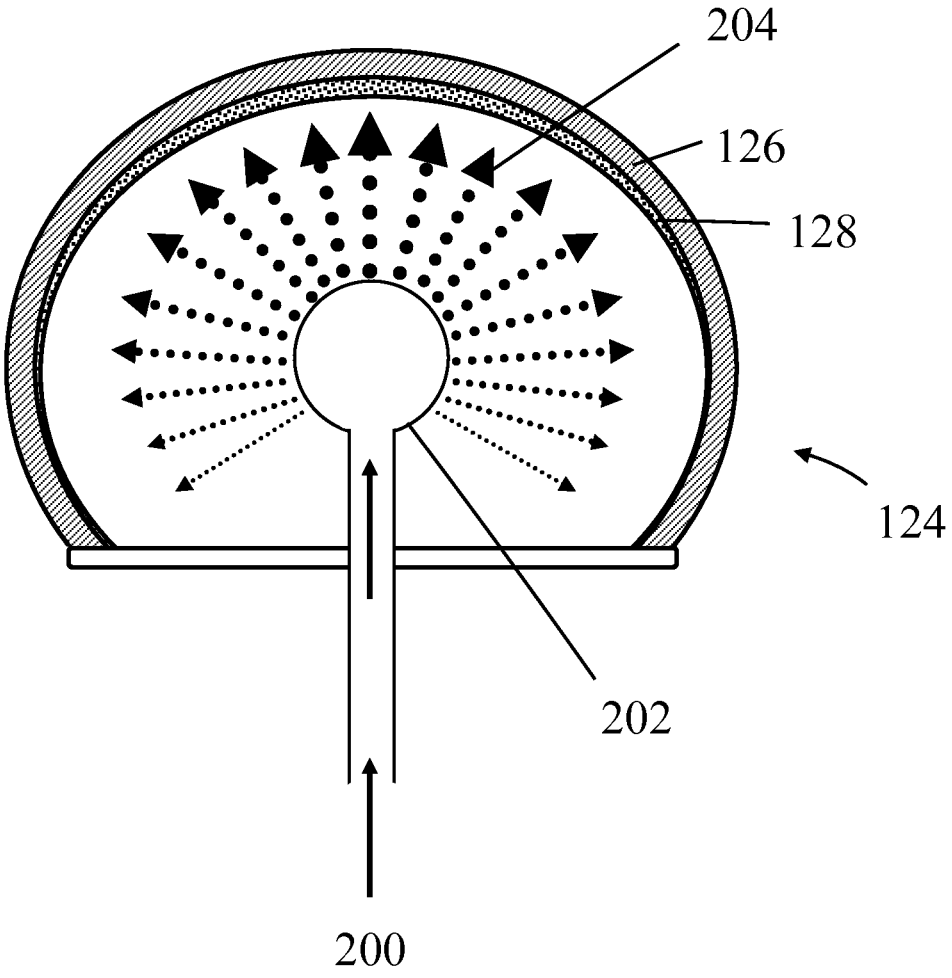
FIG. 5F is a schematic cross-sectional view illustrating a method of construction of the light diffusive cover of FIG. 5E.

FIG. 5F illustrates an approach to spray the light diffusive materials onto the light transmissive cover 126. The light diffusive materials are first mixed with a binder or carrier material to form a liquid mixture 200. Suitable examples of binder/carrier materials include, for example, silicone and/or epoxy. The liquid mixture 200 is passed through a conduit to a spray head 202 to spray the liquid mixture containing the diffusive material onto the light transmissive cover 126 so that appropriate amounts are deposited at correct locations on the cover. In the approach of FIG. 5F, the spray distribution pattern of the spray head 202 is configured to deposit relatively greater amounts of the liquid mixture 200 at the top of the cover, while relatively smaller amounts of the liquid mixture are deposited at the lower portions of the cover (In FIG. 5F the thickness of the arrows 204 indicates relative amounts of deposition). This can be configured, for example, by implementing larger-sized and/or higher flow-rate nozzle openings at the top of spray head 202, while smaller-sized and/or lower flow-rate nozzle openings are located at lower portions of the spray head 202. Alternatively, appropriately configured stencils combined with designated deposition rates can be used to spray desired amounts of the diffusive materials at different portions of the cover 124.

In operation the LEDs 110 generate blue excitation light a portion of which excite the photoluminescence material within the wavelength conversion component 122 which in response generates by a process of photoluminescence light of another wavelength (color) typically yellow, yellow/green, orange, red or a combination thereof. The portion of blue LED generated light combined with the photoluminescence material generated light gives the lamp an emission product that is white in color.

Figure 6:
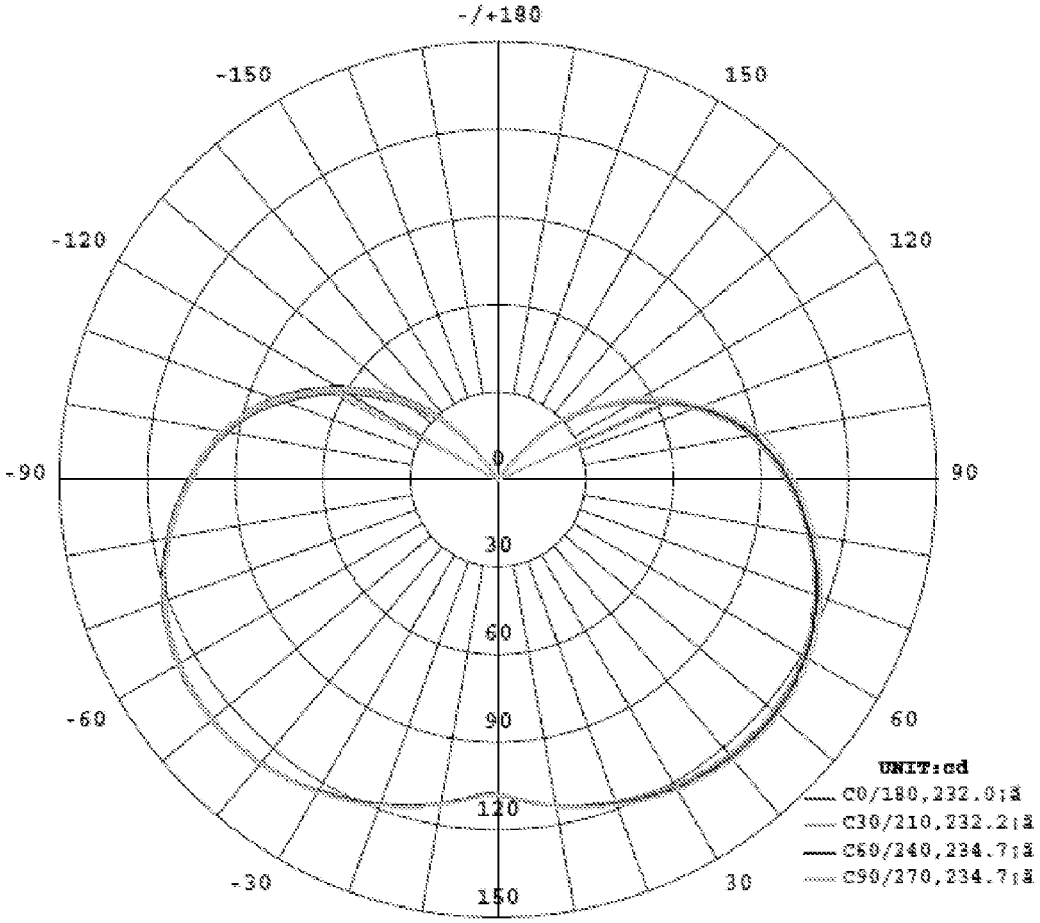
FIG. 6 is a polar diagram of measured emitted luminous intensity versus angle for the LED-based lamp of FIG. 2 without a light diffusive cover.
Figure 7:
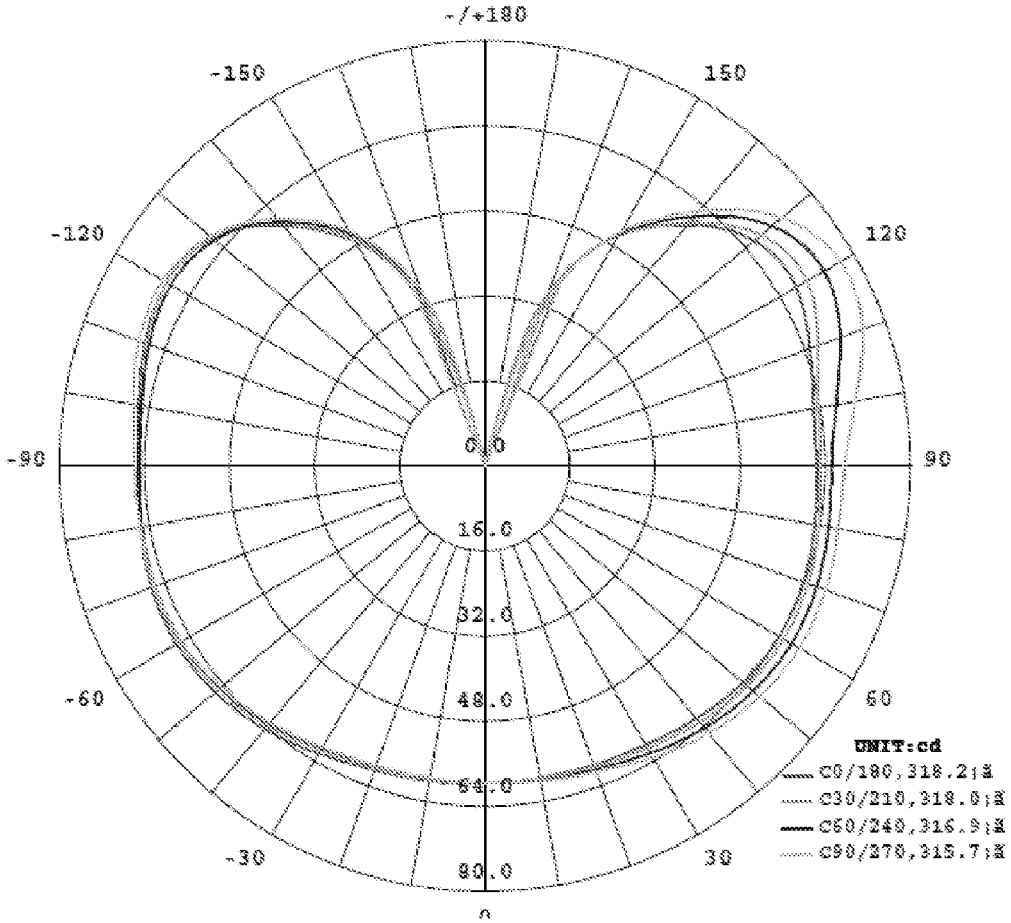
FIG. 7 is a polar diagram of measured emitted luminous intensity versus angle for the lamp of FIG. 2 including the light diffusive cover of FIG. 5A.

FIGS. 6 and 7 respectively show polar diagrams of measured emitted luminous intensity versus angle for the lamp of FIG. 2 a) without and b) with the 2-zone light diffusive cover of FIG. 5A. As can be seen from comparing these figures the light diffusive cover 124 modifies the light emission of the lamp resulting in a lamp that emits light substantially omnidirectionally. For example over an angular range of 0° to ±135° (total 270°) there is a variation in luminous intensity of less than 20%. Furthermore the lamp emits a proportion of light (about 5%) in an angular range 135° to 170. Such an emission distribution complies with the ANSI standard.

Figure 8:
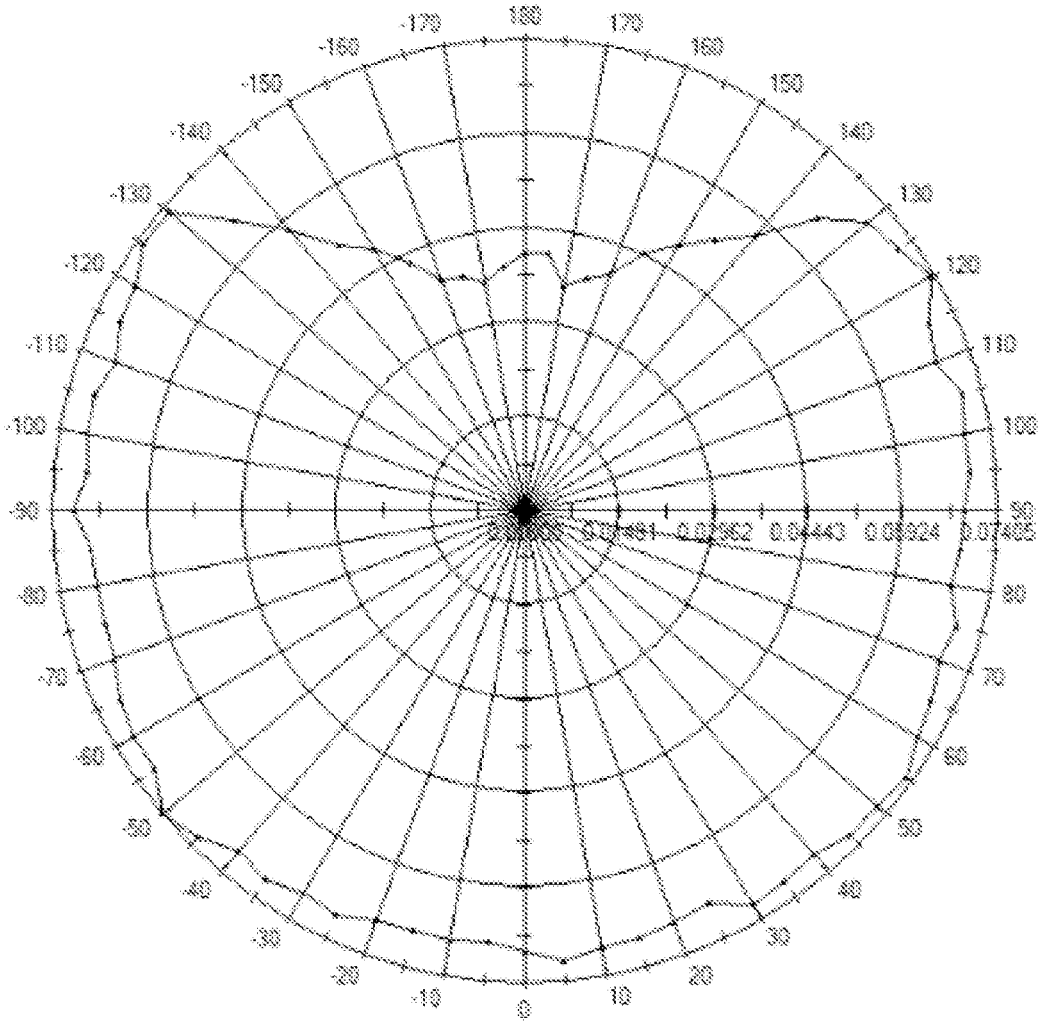
FIG. 8 is a polar diagram of calculated emitted luminous intensity versus angle for the lamp of FIG. 2 including the 4-zone light diffusive cover of FIG. 5B.

FIG. 8 shows a polar diagram of calculated luminous intensity versus angle for the lamp of FIG. 2 with the 4-zone light diffusive cover of FIG. 5B. As can be seen from this figure the light diffusive cover 124 modifies the light emission of the lamp resulting in a lamp that emits light substantially omnidirectionally. For example over an angular range of 0° to ±135° (total 270°) there is a variation in luminous intensity of less than 20%. Furthermore the lamp emits a proportion of light (about 5%) in an angular range 135° to 170. Such an emission distribution complies with the ANSI standard.

Figure 9:
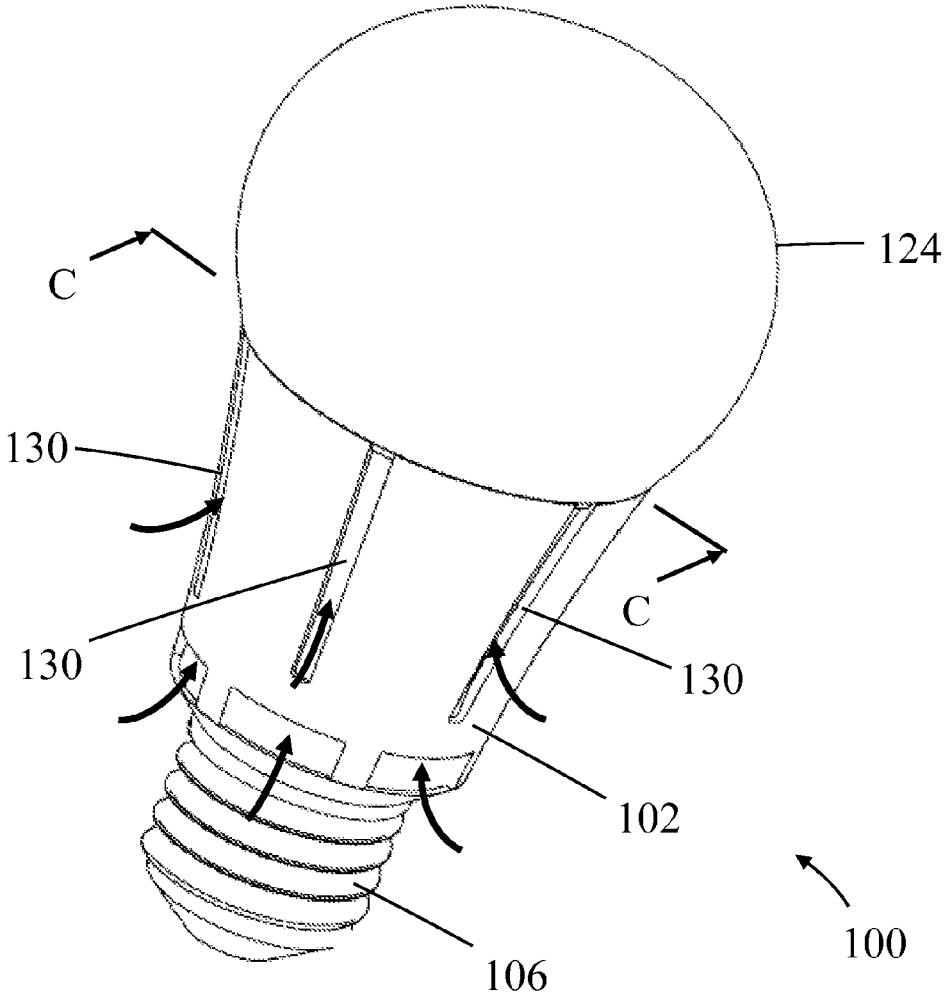
FIG. 9 is a perspective view of an LED-based lamp in accordance with an embodiment of the invention.
Figure 10:
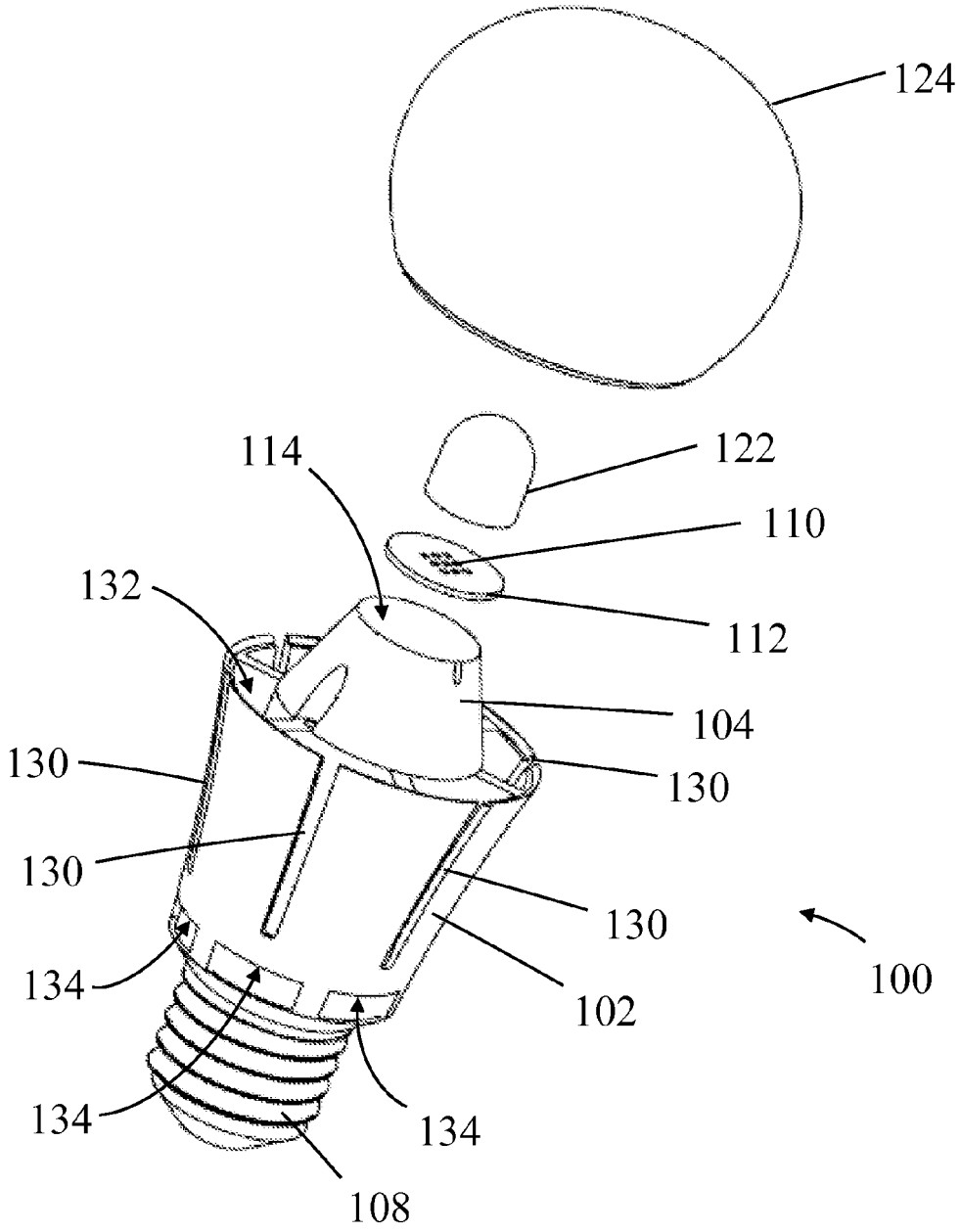
FIG. 10 is a perspective exploded view of the LED-based lamp of FIG. 8.
Figure 11:
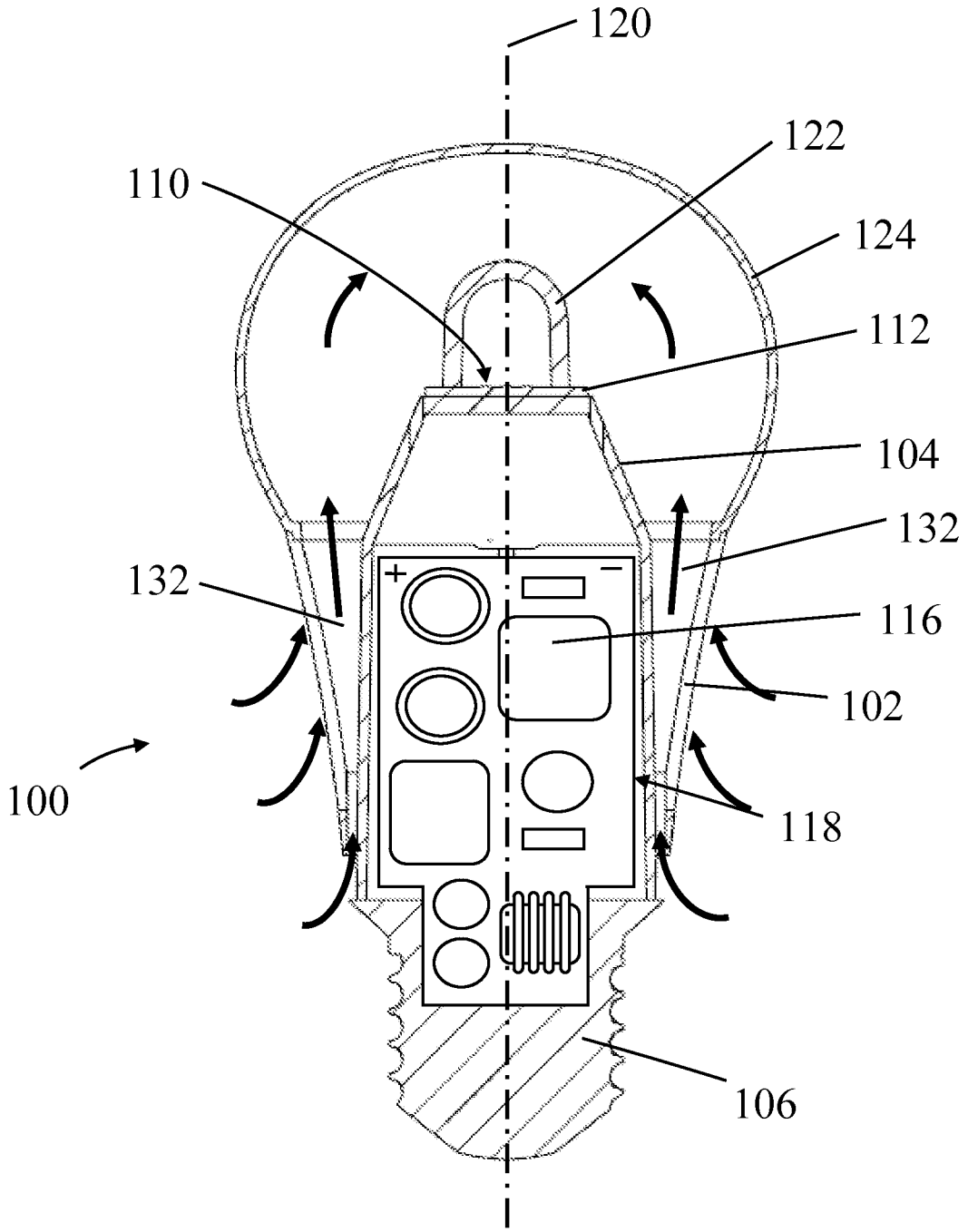
FIG. 11 is a cross-sectional view of the LED-based lamp of FIG. 8 through C-C.

FIGS. 9, 10 and 11 respectively show perspective, exploded perspective and cross-sectional views of an LED bulb in accordance with an embodiment of the invention.

An LED-based light lamp 100 in accordance with another embodiment of the invention is now described with reference to FIGS. 9 to 11 and is configured as an ENERGY STAR compliant replacement for a 60 W or 75 W A-19 incandescent light bulb with a minimum initial light output of 800 or 1,100 lumens. The major difference between this embodiment and the previously described embodiment pertains to the configuration of the thermally conductive body 102. In this embodiment the outer curved surface of the body includes a plurality of latitudinal extending slots 130 that are circumferentially spaced around the body 102. The slots 130 connect with a frustoconical sleeve shaped cavity 132. The body further comprises a series of openings 134 that are circumferentially spaced around the truncated apex of the body in proximity to the connector 106 and connect with the cavity 132. As can be best seen in FIG. 11 cavity 132 connects with the opening of the diffusive cover 124 allowing the passage of air from around the lamp into the interior volume of the cover.

As before, the body 102 is made of a material with a high thermal conductivity (typically ≥150 $Wm^{-1}K^{-1}$, preferably ≥200 $Wm^{-1}K^{-1}$) such as for example aluminum (≈250 $Wm^{-1}K^{-1}$), an alloy of aluminum, a magnesium alloy, a metal loaded plastics material such as a polymer, for example an epoxy. The body 102 can be die cast when it comprises a metal alloy or molded when it comprises a metal loaded polymer.

The heavy solid arrows in FIGS. 9 and 11 indicate how air can circulate through the body and cover to provide additional cooling of the LEDs. The direction of the arrows does not indicate the direction of air flow and they are intended to indicate paths of fluid communication.

It will be appreciated that the present invention is not restricted to the specific embodiments described and that variations can be made that are within the scope of the invention. For example, whilst the photoluminescence component has been described as comprising a hollow shell it is contemplated in other embodiments that it comprises a solid component.

In the foregoing embodiments each of the LEDs is oriented such that its principle emission axis is parallel to the axis 120 of the lamp. Such an arrangement is preferred since the LEDs can be mounted on a single planar substrate (MCPCB) which can be easily in thermal communication with the body and this substantially reduces manufacturing costs. As a consequence of such LED orientation a higher proportion of light is emitted on axis from the wavelength conversion component and the diffusive cover is described as having the highest diffusivity on axis with a decreasing diffusivity (increasing transmittance) with angle θ (FIGS. 5D and 5E) towards the connector for the lamp to achieve an omnidirectional emission characteristic. It is contemplated in alternative embodiments to mount the LEDs such that their emission axes are oriented in a generally radial direction on for example a multifaceted heat conductive pillar. In such a lamp the diffusive properties of the cover will generally be highest in the middle portion of the cover corresponding to the now highest emission direction of the wavelength conversion component with lower diffusivity (higher transmittance) regions at the top and bottom of the cover.

What is claimed:

1. A lamp comprising:

a thermally conductive body;

at least one solid-state excitation source mounted in thermal communication with the body;

a photoluminescence component containing a photoluminescence material, wherein the component is hollow and encloses the at least one excitation source; and a light transmissive cover containing a light diffusive material, wherein the cover encloses the photoluminescence component and comprises a plurality of areas having different diffusivities, wherein the plurality of areas comprises a first area and a second area, and the first area corresponds to a first diffusivity and the second area corresponds to a second diffusivity, and wherein the first diffusivity is different from the second diffusivity.

2. The lamp of claim 1, wherein the first and second areas have differing quantities of a light diffusive material per unit area.

3. The lamp of claim 2, wherein the differing quantities of the light diffusive material per unit area is controlled by at least one of: configuring a solid loading of the light diffusive material; configuring a thickness of the cover containing the light diffusive material; and configuring a thickness for a layer containing the light diffusive material.

4. The lamp of claim 1, wherein the areas comprise distinct areas of different diffusivity.

5. The lamp of claim 1, wherein the plurality of areas corresponds to at least one portion of continuously grading in terms of diffusivity.

6. The lamp of claim 1, wherein the light diffusive material is incorporated into the material comprising the cover.

7. The lamp of claim 6, wherein the thickness of the cover defines the diffusivity in each area.

8. The lamp of claim 1, wherein the light diffusive material comprises a layer on an inner or outer surface of the cover.

9. The lamp of claim 8, wherein the thickness of the layer defines the diffusivity in each area.

10. The lamp of claim 1, wherein the photoluminescence component comprises at least a part which is generally dome-shaped.

11. A lamp comprising:

a thermally conductive body;

at least one solid-state excitation source mounted in thermal communication with the body;

a photoluminescence component containing a photoluminescence material, wherein the component is hollow and encloses the at least one excitation source; and a light transmissive cover containing a light diffusive material, wherein the cover encloses the photoluminescence component and diffusivity of the cover is greatest at the top of the cover and decreases towards the bottom of the cover.

12. The lamp of claim 11, wherein the diffusivity of the cover depends on differing quantities of a light diffusive material per unit area.

13. The lamp of claim 12, wherein the differing quantities of the light diffusive material per unit area is controlled by at least one of: configuring a solid loading of the light diffusive material; configuring a thickness of the cover containing the light diffusive material; and configuring a thickness for a layer containing the light diffusive material.

14. The lamp of claim 11, wherein the light diffusive material is incorporated into the material comprising the cover.

15. The lamp of claim 14, wherein the thickness of the cover varies from the top to the bottom of the cover.

16. The lamp of claim 15, wherein at least a portion of the thickness of the cover varies continuously.

17. The lamp of claim 15, wherein the thickness of the cover varies in step-wise changes.

18. The lamp of claim 17, wherein the thickness of the cover between step-wise changes is substantially constant.

19. The lamp of claim 11, wherein the light diffusive material comprises a layer on an inner or outer surface of the cover.

20. The lamp of claim 11, wherein the photoluminescence component comprises at least a part which is generally dome-shaped.

* * * * *